US010975662B2

(12) United States Patent
Klam

(10) Patent No.: US 10,975,662 B2
(45) Date of Patent: Apr. 13, 2021

(54) TUBULAR VALVE ASSEMBLY FOR CEMENTING OF WELLBORES

(71) Applicant: Modern Wellbore Solutions Ltd., Calgary (CA)

(72) Inventor: Kyle Klam, Chestermere (CA)

(73) Assignee: Modern Wellbore Solutions Ltd., Calgary (CA)

( * ) Notice: Subject to any disclaimer, the term of this patent is extended or adjusted under 35 U.S.C. 154(b) by 0 days.

(21) Appl. No.: 16/094,177

(22) PCT Filed: Oct. 20, 2016

(86) PCT No.: PCT/CA2016/051216
§ 371 (c)(1),
(2) Date: Oct. 16, 2018

(87) PCT Pub. No.: WO2017/066877
PCT Pub. Date: Apr. 27, 2017

(65) Prior Publication Data

US 2019/0234182 A1 Aug. 1, 2019

Related U.S. Application Data

(60) Provisional application No. 62/243,698, filed on Oct. 20, 2015.

(51) Int. Cl.

| | |
|---|---|
| ***E21B 34/14*** | (2006.01) |
| ***E21B 34/10*** | (2006.01) |
| ***E21B 33/14*** | (2006.01) |

(52) U.S. Cl.
CPC ..... *E21B 34/14* (2013.01); *E21B 33/146* (2013.01); *E21B 34/10* (2013.01); *E21B 33/14* (2013.01); *E21B 2200/06* (2020.05)

(58) Field of Classification Search
CPC ..... E21B 33/146; E21B 34/10; E21B 33/14; E21B 2034/007; F21B 34/14
See application file for complete search history.

(56) References Cited

U.S. PATENT DOCUMENTS

| | | | | |
|---|---|---|---|---|
| 9,447,654 | B2 * | 9/2016 | Vick, Jr. | E21B 34/06 |
| 10,260,313 | B2 * | 4/2019 | Urdaneta Nava | E21B 33/14 |
| 10,392,898 | B2 * | 8/2019 | Giroux | E21B 34/063 |
| 2010/0224371 | A1 | 9/2010 | Swan | |
| 2015/0176367 | A1 * | 6/2015 | Hern | E21B 33/14 166/285 |

OTHER PUBLICATIONS

Search Report and Written Opinion for PCT/CA16/051216, dated Dec. 20, 2016.

* cited by examiner

*Primary Examiner* — Silvana C Runyan
(74) *Attorney, Agent, or Firm* — Fasken Martineau DuMoulin LLP

(57) ABSTRACT

Various embodiments of a tubular valve assembly for cement completion of wellbores and methods of using the tubular valve assemblies are provided.

5 Claims, 19 Drawing Sheets

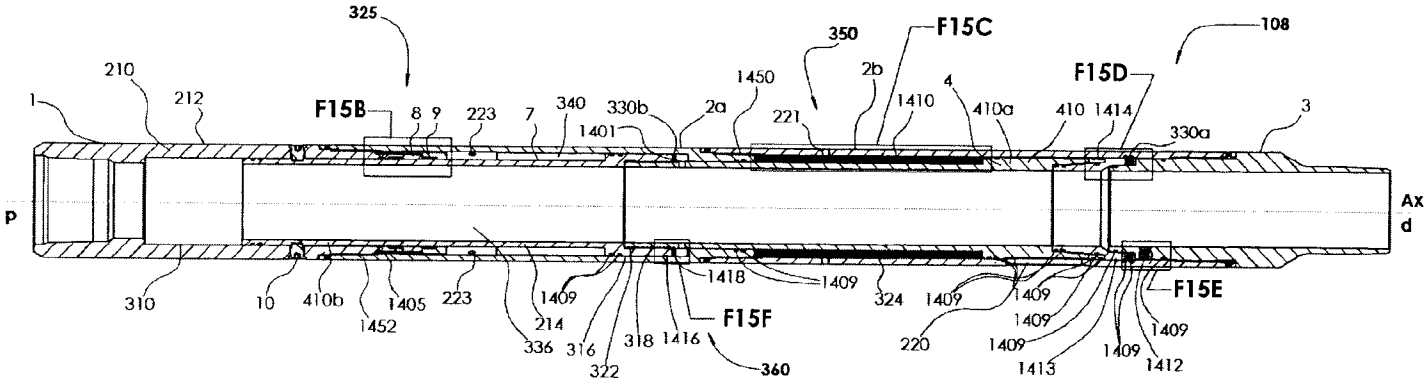
FIGURE 15A
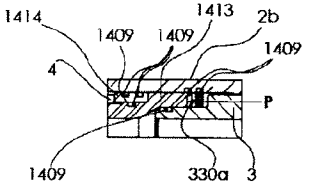
FIGURE 15D
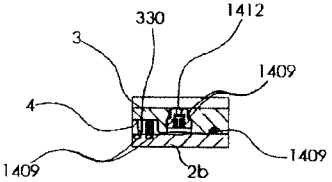
FIGURE 15E
FIGURE 15F
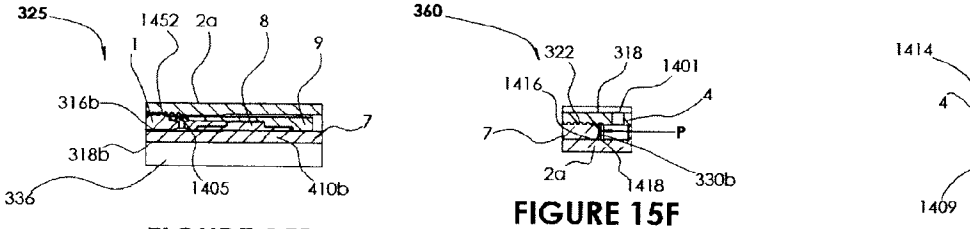
FIGURE 15B
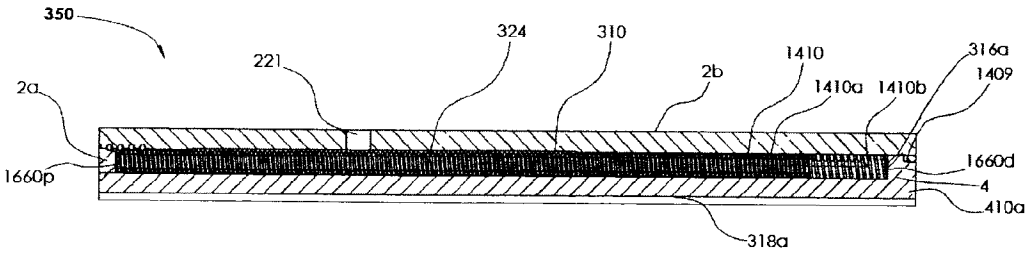
FIGURE 15C

TUBULAR VALVE ASSEMBLY FOR CEMENTING OF WELLBORES

CROSS-REFERENCE TO RELATED APPLICATIONS

This application is a National Stage submission under 37 U.S.C. § 371 of International Application No. PCT/CA 2016/051216, filed Oct. 20, 2016, which claims the benefit and priority of U.S. Provisional Application No. 62/243,698, filed Oct. 20, 2015, all of which are specifically incorporated by reference herein in their entirety.

FIELD OF THE DISCLOSURE

The present disclosure relates to a wellbore apparatus and in particular to a wellbore apparatus for cementing wellbores and methods of using the apparatus.

BACKGROUND OF THE DISCLOSURE

The following paragraphs are provided by way of background to the present disclosure. They are not however an admission that anything discussed therein is prior art or part of the knowledge of persons skilled in the art.

Subterranean oil and gas wells require the inflow of hydrocarbon products from reservoir rock formations into the well. Various methods exist for wellbore construction, known as completions, to enable transport of produced hydrocarbon products to the surface. In one well completion technique, known as cemented-back monobore, an operator will leave the distal production section of the wellbore uncased, or open hole, to expose the rock formation and permit flow of the hydrocarbon products, while the proximal non-production section is encased in cement to form what is known by those of skill in the art as a cemented completion. A cemented-back monobore completion serves to replace the intermediate casing in a standard open hole completion, saving the costs associated with this casing level, and preventing the sloughing of the build (curved) section of horizontal wellbores.

In cemented-back monobore completions, the cementing operation initially typically involves the placement of a cement staging tool along a tubular string, and insertion of the tubular string into the wellbore to arrange for the tubular string to extend essentially coaxially within the wellbore from the proximal end of the wellbore to the distal end of the wellbore.

In general, cement staging tools are tubular comprising an inner and an outer surface and ports between the inner and outer surface through which cement can selectively flow into the annular space formed between the tubular string and the wellbore wall, or, in instances where the wellbore is lined with casing, into the annular space formed between the tubular string and the casing. In order to cement the tubular string in place, cement slurry is injected from the proximal end of the tubular string downward to the cement staging tool. By opening the cement staging tool port, the cement slurry is forced to flow upward from the cement staging tool into the annulus and set therein, thereby cementing the tubing string in the wellbore.

The heretofore known cement staging tools are limited in several respects, which may include failure to open and close the ports or retain ports in an opened or closed position when required, the requirement for a separate actuation tool to close or open the ports, the requirement for a drill-out of the cement staging tool and/or a tubular string closure placed downward of the cement staging tool, following the completion of the cementing operation, or hindrance of fluid stimulation operations caused by the presence of cement debris in the tubing string following completion of the cementing operation. It is therefore desirable to provide improved cement staging tools.

SUMMARY OF THE DISCLOSURE

The following paragraphs are intended to introduce the reader to the more detailed description that follows and not to define or limit the claimed subject matter of the present disclosure.

In one aspect, the present disclosure relates to an apparatus for the cementing of wellbores.

Accordingly, the present disclosure provides, in at least one embodiment, a tubular valve assembly for cementing wellbores comprising: a first tubular member having a port through a wall of the tubular member;

a second tubular member installed inside the first tubular member, and displaceable within and relative to the first tubular member from a port closed position in which no fluid communication is allowed between an inner passage of the second tubular member and an exterior of the valve assembly to a port open position which allows for fluid communication between the inner passage and the exterior of the valve assembly;

the second tubular member comprising a piston comprising a displacement limiting device;

the first tubular member comprising a fluid aperture allowing for fluid communication between the outer surface of the first tubular member and the piston via the fluid aperture;

the second tubular member actuatable in a first axial direction by sufficient fluid pressure to displace the second tubular member inside the first tubular member from a port closed position to a port open position, until such movement is blocked by the displacement limiting device; and the second tubular member further actuatable in an opposite axial direction by a hydraulic pressure exerted on the outer surface of the assembly via the aperture, to retract the second tubular member inside the first tubular member from a port open position to a port closed position.

In one embodiment, the displacement limiting device comprises a spring coiled about the piston and a spring resistant surface fixed in position to an inside surface of the first tubular member. When the second tubular member is displaced by sufficient fluid pressure exerted on the second tubular member in a first axial direction, the spring is pressed against the spring resistant surface thereby limiting displacement of the second tubular member in the first axial direction, and when subsequently the exerted fluid pressure on the second tubular member is sufficiently diminished, the spring actuates retraction of the second tubular member in an opposite axial direction.

In other embodiments, the displacement limiting device comprises a longitudinally extending recessed profile on an outside surface of the second tubular member engageable by a lug pin displaceable in the recessed profile, and the lug pin further being displaceable in a lug ring retainer fixed in position to the inside surface of the first tubular member. When the second tubular member is displaced by sufficient fluid pressure exerted on the second tubular member in a first axial direction, the lug pin is pressed against an edge of recessed profile, thereby limiting displacement of the second tubular member in the first axial direction.

The present disclosure further provides, in at least one embodiment, a tubular valve assembly for cementing wellbores comprising:

a first tubular member having a port through a wall of the tubular member;

a second tubular member installed inside the first tubular member, and displaceable within and relative to the first tubular member from a port closed position in which no fluid communication is allowed between an inner passage of the second tubular member and an exterior of the valve assembly to a port open position which allows for fluid communication between the inner passage and the exterior of the valve assembly;

the second tubular member comprising a piston comprising a first displacement limiting device and a second displacement limiting device;

the first tubular member comprising a first fluid aperture and a second fluid aperture that both allow for fluid communication between the exterior of the first tubular member and the piston; the second tubular member being actuatable in a first axial direction by sufficient fluid pressure to displace the second tubular member inside the first tubular member from a port closed position to a port open position, until such movement is blocked by the first and second displacement limiting devices; and the second tubular member further being actuatable in the opposite axial direction by a combination of hydraulic pressure and mechanical actuation, the hydraulic pressure exerted on the outer surface of the valve assembly via the first and second apertures, and mechanical actuation being provided by the first displacement limiting device to retract the second tubular member inside the first second tubular member from the port open to the port closed position.

In some embodiments, the second tubular member comprises first and second longitudinally interlocking pistons, the first piston comprising the first displacement limiting device, and the second piston comprising the second displacement limiting device.

In some embodiments, the first displacement limiting device comprises a spring coiled about the piston and a spring surface fixed in position to the inside surface of the first tubular member. For example, in one embodiment, a surface formed by a collar circumferentially attached to the outside surface of the piston and to the inside surface of the first tubular member. When the second tubular member is displaced by sufficient fluid pressure exerted on the second tubular member in a first axial direction, the spring is pressed against the spring resistant surface thereby limiting displacement of the second tubular member in the first axial direction, and when subsequently the exerted fluid pressure on the second tubular member is sufficiently diminished, the spring actuates retraction of the second tubular member in an opposite axial direction.

In some embodiments, the second displacement limiting device comprises a longitudinally extending recessed profile on the outside surface of the second tubular member engageable by a lug pin displaceable in the recessed profile, and further displaceable in a lug ring retainer fixed in position to the inside surface of the first tubular member. When the second tubular member is displaced by sufficient fluid pressure exerted on the second tubular member in a first axial direction, the lug pin is pressed against an edge of recessed profile, thereby limiting displacement of the second tubular member in an opposite axial direction.

In a further embodiment, the valve assembly comprises a third displacement limiting device, capable of retaining the valve assembly in a fully closed position even when pressure in the first axial direction is applied against the second tubular member.

In another aspect, the present disclosure relates to a process for controlling cement flow in a subterranean well.

Accordingly, in at least one embodiment, the present disclosure provides a method of controlling cement flow from an inner passage of a tubular string to the exterior thereof, the method comprising:

constructing a tubular valve assembly for interconnecting the tubular string, the valve assembly comprising:

a first tubular member having a port through a wall of the tubular member;

a second tubular member installed inside the first tubular member, and displaceable within the first tubular member from a port closed position in which no fluid communication is allowed between the inner passage and an exterior of the tubular valve assembly to a port open position which allows for fluid communication between the inner passage and the exterior of the tubular valve assembly;

the second tubular member comprising a piston comprising a displacement limiting device;

the first tubular member comprising a fluid aperture allowing for fluid communication between the exterior of the first tubular member and the piston via the fluid aperture;

the second tubular member actuatable in a first axial direction by sufficient fluid pressure to displace the second tubular member inside the first tubular member from a port closed position to a port open position, until such movement is blocked by the displacement limiting device; and the second tubular member being further actuatable in an the opposite axial direction by hydraulic pressure exerted on the outer surface of the valve assembly via the aperture, the pressure acting to retract the second tubular member inside the first second tubular member from the port open position to the port closed position;

displacing the second tubular member relative to the first tubular member in the first axial direction and opening the port;

supplying a flow of cement slurry through the inner passage of the tubular valve assembly, wherein the cement slurry flows between the inner passage of the tubular valve assembly and the exterior of the tubular valve assembly through the port;

reducing the cement slurry flow; and displacing the second tubular member relative the first tubular member in an opposite axial direction by actuating the displacement limiting device in an opposite axial direction and closing the port.

In another aspect, in at least one embodiment, the present disclosure further provides a method of controlling cement flow from an inner passage of a tubular string to the exterior thereof, the method comprising:

constructing a tubular valve assembly for interconnecting the tubular string, the valve assembly comprising:

a first tubular member having a port through a wall of the tubular member;

a second tubular member installed inside the first tubular member, and displaceable within the first tubular member from a port closed position in which no fluid communication is allowed between the inner passage and the exterior of the tubular valve assembly to a port open position in which fluid communication is allowed between the inner passage and the exterior of the tubular valve assembly;

the second tubular member comprising a piston comprising a first displacement limiting device and a second displacement limiting device;

the first tubular member comprising a first fluid aperture and a second fluid aperture that both allow for fluid communication between the exterior of the first tubular member and the piston;

the second tubular member being actuatable in a first axial direction by sufficient fluid pressure to displace the second tubular member inside the first tubular member from a port closed position to a port open position, until such movement is blocked by the first and second displacement limiting devices; and the second tubular member further being actuatable in an opposite axial direction by a combination of hydraulic pressure and mechanical actuation, the hydraulic pressure being exerted on the outer surface of the valve assembly via the first and second apertures, and the mechanical actuation being provided by the first displacement limiting device to retract the second tubular member inside the first second tubular member from the port open position to the port closed position;

displacing the second tubular member relative to the first tubular member in the first axial direction and opening the port;

supplying a flow of cement slurry through the inner passage of the tubular valve assembly, wherein the cement slurry flows between the inner passage of the tubular valve assembly and the exterior of the tubular valve assembly through the port;

reducing the cement slurry flow; and displacing the second tubular member relative to the first tubular member in an opposite axial direction by actuating the first and second displacement limiting devices in an opposite axial direction and closing the port.

In some embodiments, the process further comprises: eliminating cement debris through a valve at the distal end of the tubular string.

In another aspect, the present disclosure relates to a process for controlling fluid flow in a subterranean well.

Accordingly, in at least one embodiment, the present disclosure provides a process for controlling fluid flow from an inner passage of a tubular string to the exterior thereof, the method comprising:

constructing a tubular valve assembly for interconnecting the tubular string, the valve assembly comprising:

a first tubular member having a port through a wall of the tubular member;

a second tubular member installed inside the first tubular member, and displaceable within the first tubular member from a port closed position in which no fluid communication is allowed between the inner passage and an exterior of the tubular valve assembly to a port open position in which fluid communication is allowed between the inner passage and the exterior of the tubular valve assembly;

the second tubular member comprising a piston comprising a displacement limiting device;

the first tubular member comprising a fluid aperture allowing for fluid communication between the exterior of the first tubular member and the piston;

the second tubular member being actuatable in a first axial direction by sufficient fluid pressure to displace the second tubular member inside the first tubular member from the port closed position to the port open position, until such movement is blocked by the displacement limiting device; and the second tubular member further being actuatable in an opposite axial direction by hydraulic pressure exerted on the outer surface of the valve assembly via the aperture so that the second tubular member is retracted inside the first second tubular member from the port open position to the port closed position;

supplying a fluid through the inner passage of the tubular valve assembly at a pressure that is sufficient to displace the second tubular member relative to the first tubular member in an axial direction and open the port at least partially; and then reducing the pressure level at which the fluid is provided to displace the second tubular member relative to the first tubular member and at least partially closing the port, thereby diminishing fluid communication between the inner passage and the exterior of first tubular member.

In a further aspect, in at least one embodiment, the present disclosure provides a process for controlling fluid flow from an inner passage of a tubular string to the exterior thereof, the method comprising:

constructing a tubular valve assembly for interconnecting the tubular string, the valve assembly comprising:

a first tubular member having a port through a wall of the tubular member;

a second tubular member installed inside the first tubular member, and displaceable within the first tubular member from a port closed position in which no fluid communication is allowed between the inner passage and the exterior of the tubular valve assembly to a port open position in which fluid communication is allowed between the inner passage and the exterior of the tubular valve assembly;

the second tubular member comprising a piston comprising a first displacement limiting device and a second displacement limiting device;

the first tubular member comprising a first fluid aperture and a second fluid aperture that both allow for fluid communication between the exterior of the first tubular member and the piston;

the second tubular member being actuatable in a first axial direction by sufficient fluid pressure to displace the second tubular member inside the first tubular member from the port closed position to the port open position, until such movement is blocked by the first and the second displacement limiting devices; and the second tubular member further being actuatable in an opposite axial direction by a combination of hydraulic pressure and mechanical actuation, the hydraulic pressure exerted on the outer surface of the valve assembly via the first and second fluid apertures, and the mechanical actuation being provided by the first displacement limiting device to retract the second tubular member inside the first tubular member from the port open position to the port closed position;

supplying a fluid through the inner passage of the tubular valve assembly at a pressure that is sufficient to displace the second tubular member relative to the first tubular member in a first axial direction and open the port at least partially; and then reducing the pressure at which the fluid is provided to displace the second tubular member relative the first tubular member and at least partially close the port, thereby diminishing fluid communication between the inner passage and the exterior of first tubular member.

In one embodiment, the controlled fluid is water. In another embodiment, the controlled fluid is a completion fluid.

In some of the herein provided embodiments, the first axial direction is a downward direction (i.e. away from the earth's surface in the wellbore) and the opposite axial direction is an upward direction (i.e. towards the earth's surface in the wellbore), while in other embodiments the first axial direction is an upward direction and the opposite direction is a downward direction.

Other features and advantages or the present disclosure will become apparent from the following detailed description. It should be understood, however, that the detailed description, while indicating preferred implementations of the present disclosure, are given by way of illustration only, since various changes and modifications within the spirit and scope of the disclosure will become apparent to those of skill in the art from the detailed description.

BRIEF DESCRIPTION OF THE DRAWINGS

The disclosure is in the hereinafter provided paragraphs described in relation to its figures. The figures provided herein are provided for illustration purposes and are not intended to limit the present disclosure. Like numerals designate like or similar features throughout the several views possibly shown situated differently or from a different angle. Thus, by way of example only, part 3 in FIG. 2 and FIG. 3 refers to a tubular extension in both of these figures.

FIGS. 15A-15F depict a longitudinal cross-sectional view of a tubular valve assembly according to an embodiment of the present disclosure (FIG. 15A) and various magnified views of portions F15B-F15F thereof (FIGS. 15B-15F).

The figures together with the following detailed description make apparent to those skilled in the art how the disclosure may be implemented in practice.

DETAILED DESCRIPTION OF THE DISCLOSURE

Various apparatuses and processes will be described below to provide an example of an embodiment of each claimed subject matter. No embodiment described below limits any claimed subject matter and any claimed subject matter may cover any apparatuses, assemblies, methods, processes, or systems that differ from those described below. The claimed subject matter is not limited to any apparatuses, assemblies, methods, processes, or systems having all of the features of any apparatuses, assemblies, methods, processes, or systems described below or to features common to multiple or all of the any apparatuses methods, processes, or systems below. It is possible that an apparatus, assembly, method, process, or system described below is not an embodiment of any claimed subject matter. Any subject matter disclosed in an apparatus, assembly, method, process, or system described below that is not claimed in this document may be the subject matter of another protective instrument, for example, a continuing patent application, and the applicants, inventors or owners do not intend to abandon, disclaim or dedicate to the public any such subject matter by its disclosure in this document.

All publications, patents, and patent application are herein incorporated by reference in their entirety to the same extent as if each individual publication, patent or patent application was specifically and indicates to be incorporated by reference in its entirety.

Several directional terms such as "above", "below", "lower" and "upper" are used herein for convenience including for reference to the drawings. In general "upper", "above", "upward" and "proximal" and similar terms are used to refer to a direction towards the earth's surface, while "lower", "below", "downward" and "distal" refer to a direction generally away from the earth's surface along the wellbore.

As used herein, the wording "and/or" is intended to represent an inclusive-or. That is, "X and/or Y" is intended to mean X or Y or both, for example. As a further example, "X, Y, and/or Z" is intended to mean X or Y or Z or any combination thereof.

Figure 1:
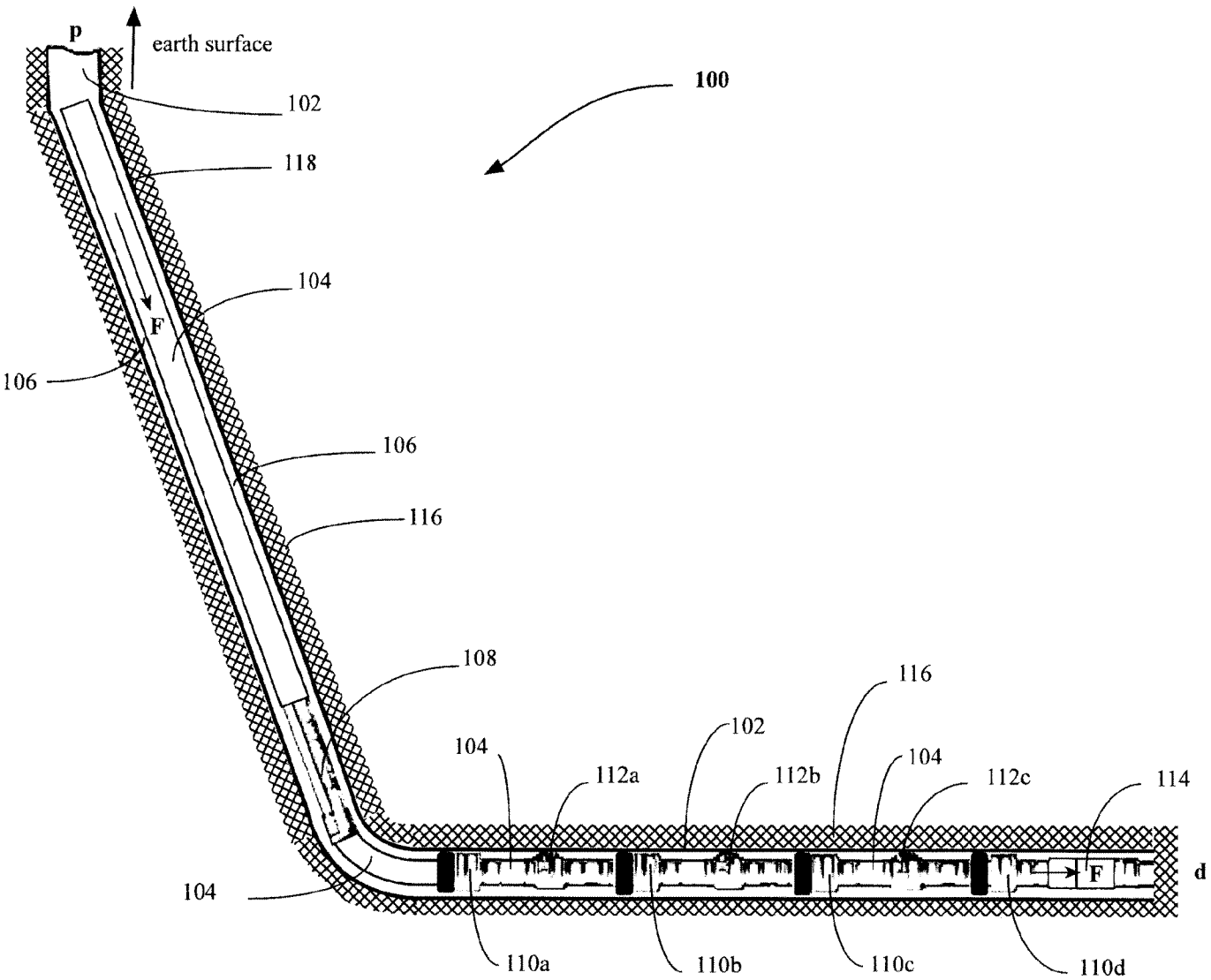
FIG. 1 depicts a plan side view of an example configuration of a wellbore system in which the tubular valve assembly and methods of the present disclosure may be deployed.

Referring to FIG. 1, shown therein is a representative general plan side view of a subterranean well system 100 representing some of the principles of at least one embodiment of the present disclosure. The well system 100 comprises a wellbore 102 defined by a wellbore wall 118 drilled into reservoir rock 116 and having a proximal end p and a distal end d. A tubular string 104 is inserted in the wellbore 102, thereby forming an axially extending annulus 106 between the wellbore wall 118 and the tubular string 104. The tubular string 104 may be cemented into the wellbore using the tubular cementing assembly 108 and methods of the present disclosure to form a cemented completion. The tubular string 104 of the well system 100 further comprises several operational devices that are conventionally used in a multi stage open hole fluid stimulation operation including liner packers 110*a*, 110*b*, 110*c*, and 110*d*, allowing for sectional fluid stimulation, stimulation fluid ports 112*a*, 112*b* and 112*c*, which may be selectively opened and closed, and a wellbore isolation valve 114. Fluid circulation may be set up at the proximal end p of the well so that fluid migrates through the liner 104, as indicated by the arrows F to the distally located wellbore isolation valve 114, whence the fluid may flow into the annulus 106. It should be clearly understood that the cementing assembly and methods of the present disclosure are not limited in any way to use in conjunction with the well system 100 shown in FIG. 1. On the contrary, other well systems having a requirement for a cementing operation may be constructed and the cementing assembly and methods of the present disclosure may be used in conjunction with a wide variety of well systems, operational devices and configurations.

Figure 2A:
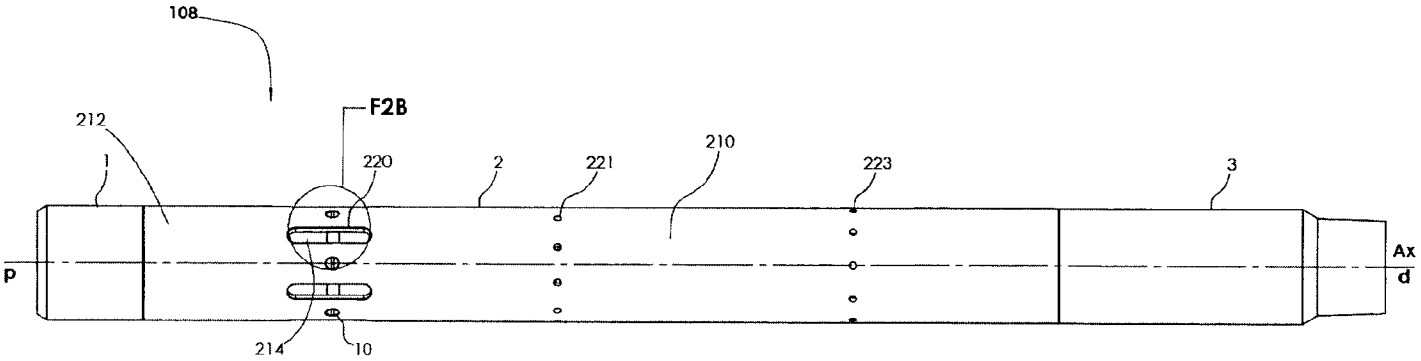
FIG. 2A-2B depicts a side view of a tubular valve assembly according to an embodiment of the present disclosure (FIG. 2A) and a magnified view of a portion F2B thereof (FIG. 2B).

Referring now to FIG. 2A, shown therein is a side view of an embodiment of a generally tubular cementing assembly 108 having a longitudinal axis Ax and a proximal end p and distal end d, wherein when implemented in a cemented completion the tubular cementing assembly 108 is generally positioned coaxially with the wellbore (not shown), with the proximal end p of the tubular cementing assembly 108 closest to the proximal end (i.e. closest to the earth's surface) of the wellbore and the distal end d of the tubular cementing assembly 108, closest to the distal end of the wellbore. Further shown in FIG. 2A is a first tubular member 210 having an outer surface 212 and an inner surface (not shown) and comprising a central housing 2 and two removable tubular extensions, proximally positioned removable tubular extension 1, and distally positioned removable tubular extension 3. A second tubular member 214 having a smaller diameter than the first tubular member 210, is inserted in the central housing 2 and after placement of tubular extensions 1 and 3 the second tubular member 214 is secured within the first tubular member 210. The removable extensions 1 and 3 may be attached to the central housing 2 through a screw thread optionally combined with sealing O-rings or using any other suitable attachment device capable of securing the extensions 1 and 3 to the central housing 2.

Figure 2B:
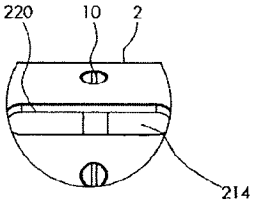

It is further noted that in another embodiment, the first tubular member 210 comprises a central housing and only a proximally positioned removable tubular extension, and in another embodiment, the first tubular member 210 comprises a central housing and only a distally positioned removable tubular extension, and in yet another embodiment, the first tubular member 210 comprises only a central housing, lacking tubular extensions. Further shown in FIG. 2A and FIG. 2B, representing a magnified view of portion F2B indicated in FIG. 2A, are ports 220 forming a connection between the outside surface 212 and the inner surface of the tubular member 210 (and through which a small portion of the outside surface of the second tubular member 214 is partially visible). The here shown embodiment comprises several ports 220 which may be opened and closed by displacement of the second tubular member 214 within first tubular member 210. In general, in accordance herewith, the first tubular member 210 comprises at least one port. In other embodiments, the first tubular member 210 comprises 2, 3, 4, 5, 6, 7, 8, 9, 10 or more ports which may be opened and closed and are sufficiently large for cement slurry to smoothly pass therethrough. Further shown in FIG. 2A are two series of apertures 221 and 223 also forming a fluid connection between the outside surface 212 and the inner surface of the tubular member 210. Further shown in FIG. 2A and FIG. 2B are shear pins 10.

Figure 14A:
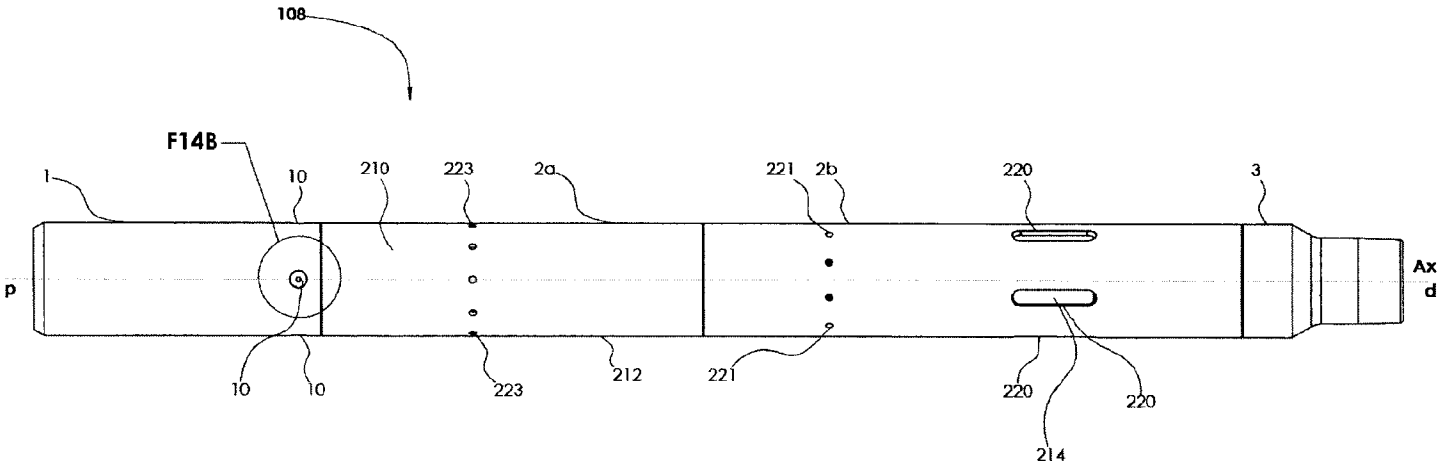
FIGS. 14A-14B depict a side view of a tubular valve assembly according to an embodiment of the present disclosure and a magnified view of a portion F14B of the tubular valve assembly.
Figure 14B:
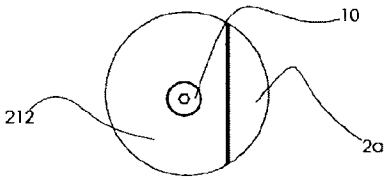

It is noted that, in different embodiments, the relative positions of the port or ports 220, and the two (or more) series of apertures 221 and 223 on the first tubular member 210 may vary. Thus, referring to FIG. 14A, in one example embodiment, the ports 220 are positioned distally relative to the two series of apertures 221 and 223. Furthermore, in some embodiments, the central housing can comprise two central housing portions (2*a* and 2*b*), for example, for ease of manufacturing, as shown in FIG. 14A, or, in other alternative embodiments, the central housing consists of even more portions. Central housing portions 2*a* and 2*b* can be interconnected to form a substantially contiguous central housing 2. In addition, the position of the shear pins 10 relative to the ports 220 may vary. For example, in one embodiment, the shear pins 10 can be located in the proximity of the ports 220 and proximally relative to the series of apertures 221 and 223 (as shown in FIG. 2A). Furthermore, the shear pins 10 can be located within the tubular extension 1 (as shown in FIG. 14A) or tubular extension 3 (not shown). Referring to FIG. 14B, shown therein is a magnified view of a portion F14B indicated in FIG. 14A showing the portion of the outer surface 212, showing a shear pin 10, located in tubular extension 1.

Figures 3A, 3B, 3C, 3D:
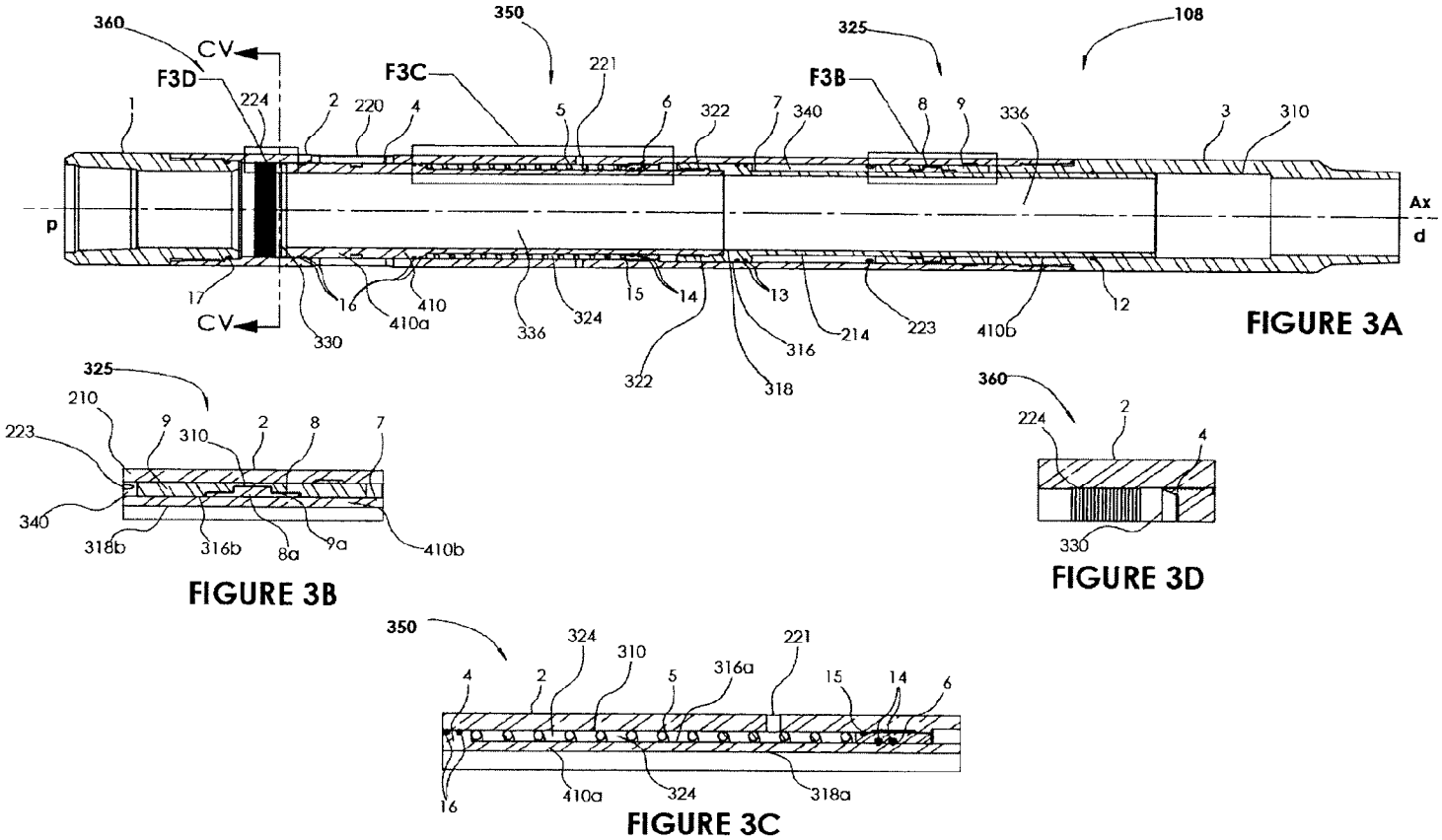
FIGS. 3A-3D depict a longitudinal cross-sectional view of a tubular valve assembly according to an embodiment of the present disclosure (FIG. 3A) and various magnified views of a portions F3B-F3D thereof (FIG. 3B-3D).
Figure 4:
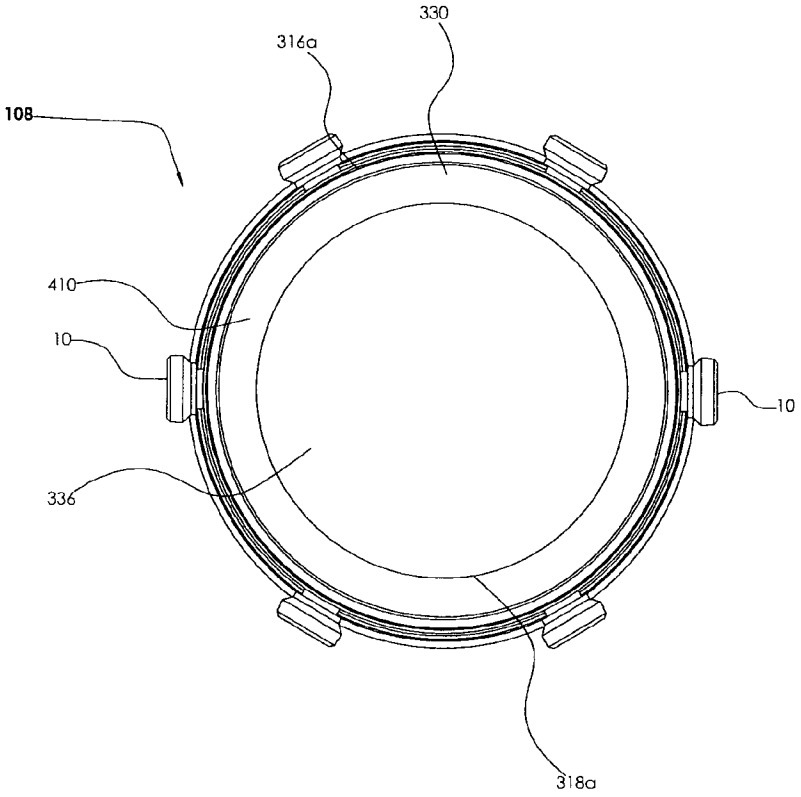
FIG. 4 depicts a cross-sectional view of a tubular valve assembly according to an embodiment of the present disclosure.

Referring to FIG. 3A and FIG. 4 now, shown therein are cross-sectional views of the embodiment of the tubular cementing assembly 108 shown in FIG. 2A. The cross-sectional view shown in FIG. 3A represents a section taken through a plain generally through the central longitudinal axis Ax of the tubular cementing assembly 108, while the cross-sectional view in FIG. 4 represents a section taken through plain CV noted in FIG. 3A perpendicular to the longitudinal axis Ax. In FIG. 3A, proximal end p and distal end d are indicated. The first tubular member 210 having an outer surface 212 and inner surface 310 is shown, as are the central housing 2 and tubular extensions 1 and 3 of the first tubular member 210, and ports 220 and apertures 221 and 223 therein. Further shown is a second tubular member 214 having an outer surface 316, an inner surface 318 and a wall 410 together forming a longitudinal tubular bore or passage 336 and inserted displaceably in the axial direction inside the first tubular member 210. The tubular member 214 is displaceable in a downward axial direction inside the tubular member 210. In alternate embodiments, the tubular member 214 is displaceable in upward axial direction inside the tubular member 210, for example, as shown in FIGS. 15A-15F.

The second tubular member 214 comprises a proximally positioned piston 4 having an outer surface 316*a*, an inner surface 318*a* (see: FIG. 3C), a wall 410*a*. The second tubular membrane 214 also comprises a distally positioned piston 7 having an outer surface 316*b* and inner surface 318*b* (see: FIG. 3B), and a wall 410*b*. Proximally positioned piston 4 has a fluid pressure actuatable surface 330 (see: FIG. 3D and FIG. 4). In the embodiments shown in FIG. 3 and FIG. 4 the fluid actuatable surface 330 is the circumferentially exposed surface of the wall 410. In other embodiments, other fluid pressure actuatable surfaces may be used, provided however, that a sufficiently large continuous tubular bore for the flow of cement slurry through the tubular bore is formed. The distal end of the piston 4 is linked to the proximal end of piston 7, through linkage 322.

In the embodiment shown in FIG. 3A, the distal end of the proximally positioned piston 4 fits into a widening portion at the proximal end of distally positioned piston 7. The linkage can be provided by a screw thread optionally combined with sealing O-rings or any other suitable attachment device capable of securing piston 4 to piston 7. The here shown embodiment comprises several apertures 221 and 223 providing permanent fluid communication between the outer surface 212 and the inner surface 310 of the first tubular member 210. When installed in a fluid filled annulus, apertures 221 provide permanent fluid communication between the exterior of the first tubular member 210 and the piston 4. Similarly, apertures 223 provide permanent fluid communication between the exterior of the first tubular member 210 and the piston 7.

In general, in accordance herewith, the first tubular member comprises at least one aperture providing permanent fluid communication between the exterior of the first tubular member and the proximally positioned piston, and at least one aperture providing permanent fluid communication between the exterior of the first tubular member and the distally positioned piston. In other embodiments, the first tubular member comprises 2, 3, 4, 5, 6, 7, 8, 9, 10 or more apertures providing permanent fluid communication between the exterior of the first tubular member and the proximally positioned piston and/or 2, 3, 4, 5, 6, 7, 8, 9, 10 or more apertures providing permanent fluid communication between the exterior of the first tubular member and the distally positioned piston.

In other embodiments, the second tubular member consists of a single contiguous piston, and in yet other embodiments, the second tubular member consists of 3, 4, 5 or more pistons. Certain advantages of embodiments comprising a plurality of pistons will hereinafter be explained. Embodiments of the tubular cementing assembly comprising a single contiguous piston may be easier to manufacture.

Further shown in FIG. 3A are a proximally positioned first displacement limiting device 350 and a distally positioned second displacement limiting device 325, wherein displacement limiting device 350 limits displacement of piston 4 in the distal direction when pressure is exerted on piston 4 in a longitudinal direction (as hereinafter further described) within the first tubular member 210 and displacement limiting device 325 limits displacement of piston 7 within the tubular member 210 when pressure is exerted in a longitudinal direction on piston 7 (as hereinafter further described). Displacement limiting device 325 is further capable of reversing displacement of piston 4 in the proximal direction, following opening or partially opening of the system, resulting in a subsequent partly closed or fully closed position. In further alternate embodiments, additional displacement limiting devices may be included. Thus, for example, in some embodiments, 3, 4, 5, 6, 7, 8, 9, 10 or more displacement limiting devices may be included in embodiments where in the second tubular member 214, comprises 3, 4, 5, 6, 7, 8, 9, 10 or more pistons. This may include an embodiment comprising a plurality of the displacement limiting devices 325 or the displacement limiting devices 350, or any combination thereof.

In other embodiments, the second tubular member comprises a piston comprising only one displacement limiting device, including displacement limiting device 325 or displacement limiting device 350. In such embodiments, the first tubular member may comprise only one aperture providing permanent fluid communication between the exterior of the first tubular member and the piston.

Referring to FIG. 3C, shown therein is a magnified view of portion F3C indicated in FIG. 3A including the displacement limiting device 350 comprising a spring 5 coiled about piston 4, and fitting in a recess of the outer surface 316*a* of piston 4, and further defined by the inner surface 310 of the central housing 2 of the first tubular member 210, forming a chamber 324, and a spring resistant surface formed by collar 6 attached and sealed by O-rings 14 to the outer surface 316*a* of piston 4 and fixed in position and attached to the inner surface 310 of the central housing 2 of the first tubular member 210. Chamber 324 is in fluid communication with the outer surface of the first tubular member 210 through aperture 221.

In an alternate embodiment, the first displacement limiting device can comprise a chamber comprising a compressed gas, wherein the chamber is in fluid communication with the outer surface of the first tubular member through an aperture.

Figure 5A:
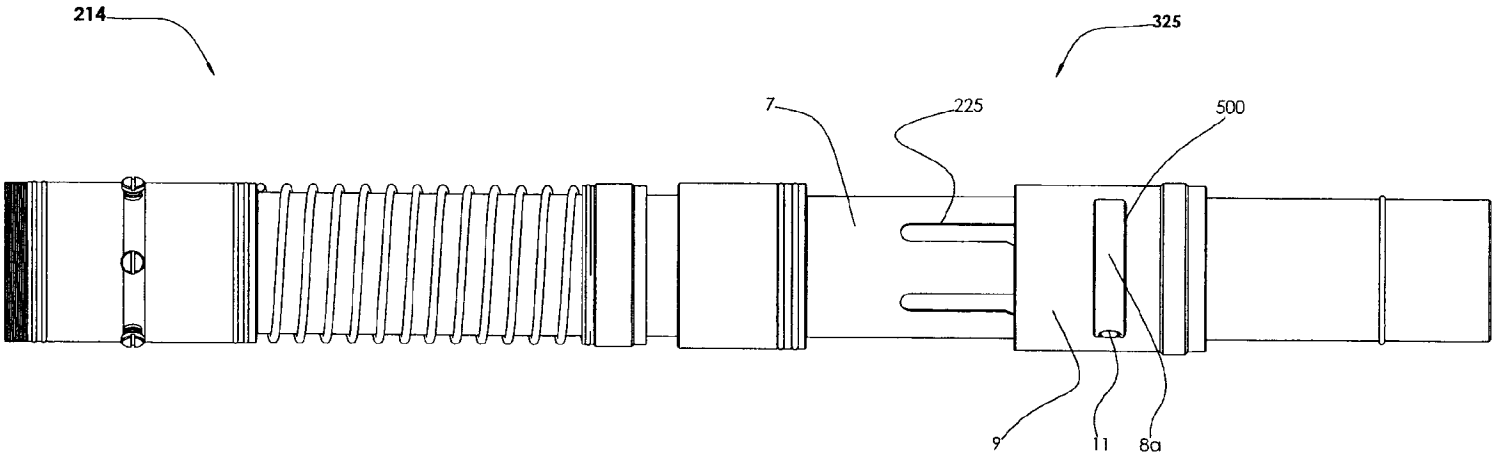
FIGS. 5A-5B depict side views of one embodiment of one of the tubular members of the tubular valve assembly of the present disclosure, including assembled displacement limiting devices (FIG. 5A) and one partially disassembled displacement limiting device (FIG. 5B).
Figure 5B:
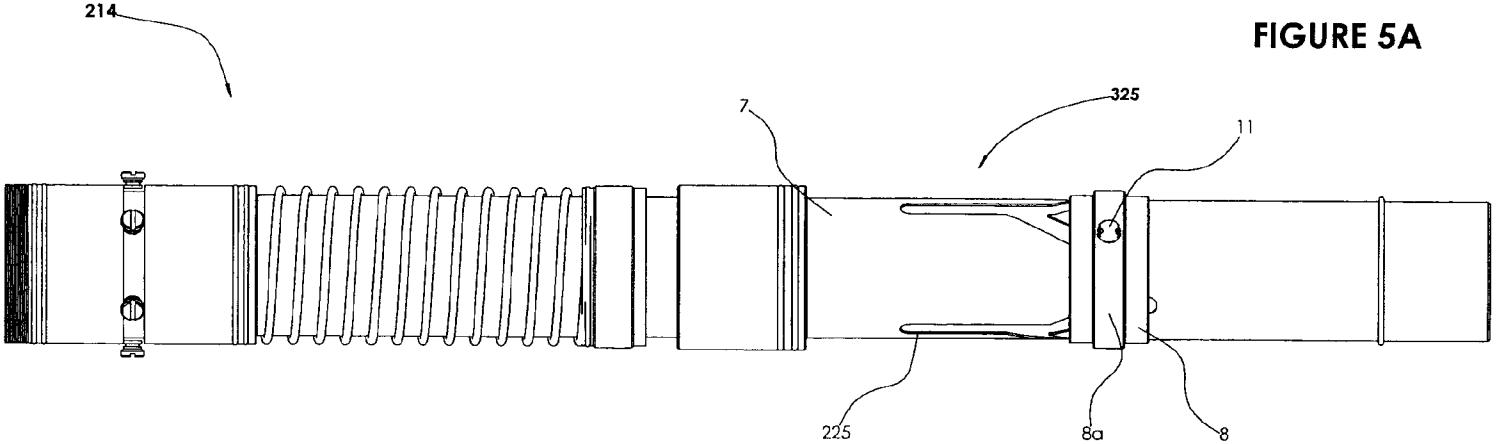

Referring to FIG. 3B, and FIGS. 5A-5B, shown therein is a magnified view of portion F3B indicated in FIG. 3A and a side view of the second tubular member 214 comprising displacement limiting device 325 comprising a lug ring 8 capable of rotational movement about piston 7 and a retainer 9 fixed in position and attached to the inner surface 310 of the central housing 2. The lug ring 8 comprises a central circumferential elevation 8*a* on the outside surface of lug ring 8, generally loosely fitting into a central circumferential recess 9*a* on the inside surface of lug retainer 9, allowing for lug ring 8 to rotate about piston 7. In the embodiment show in FIG. 5A, the circumferential elevation 8*a* of the lug ring 8 is visible through a circumferentially extending aperture 500 in the lug ring retainer 9. In the side view shown in FIG. 5B, the lug ring retainer has been removed exposing the lug ring 8. Lug ring 8 further comprises lug pin 11 attached to the lug ring 8 engaged in a generally longitudinally extending profile F representing a recess in the outer surface 316*b* of the piston 7. Piston 7, when pressure is applied thereto in a longitudinal direction (as hereinafter described), can displaceably move in a longitudinal direction relative to lug ring retainer 9. Such movement results in lug pin 11 moving through profile 225. FIG. 3A and FIG. 3B further show a recess in the outer surface 316*b* of piston 7, forming a chamber 340 between the outer surface 316*b* of piston 7 and the inner surface of 310 of the central housing 2 of the first tubular member 210. Chamber 340 is in fluid communication with the annulus via aperture 223.

Further shown in FIG. 3A are a single O-ring 12, a pair of O-rings 13, a pair of O-rings 14, a single O-Ring 15, two pairs of O-rings 16, and a single O-ring 17 generally sealing metal-to-metal surfaces. In alternate embodiments, the O-rings may be replaced with bonded or molded seals that facilitate assembly and maintain sealing capability after being exposed, for example, when the second tubular member 214 is shifted to open ports 220, and as shown by the molded seal sleeve 1414 in FIGS. 15A and 15F. Specifically, the single O-ring 12 seals the metal-to-metal surface between the inner surface of the distal tubular extension 3 and the outer surface 316*b* of piston 7, the pair of O-rings 13 seal the metal-to-metal surface between the inner surface 310 of the first tubular member 210 and the outer surface 316*b* of the piston 7; the pair of O-rings 14 seal the metal-to-metal surface between the outer surface 316*a* of the piston 4 and collar 6 of the displacement limiting device 350; the O-ring 15 seals the metal-to-metal surface between inner surface 310 of the first tubular member 210 and the collar 6 of the displacement limiting device 350; the two pairs of O-rings 16 seal the metal-to-metal surface between the inner surface 310 of the first tubular member 210 and outer surface 316*a* of the piston 4; and single O-ring 17 seals the metal-to-metal surface between the outer surface of the proximal tubular extension 1 and the inner surface of the central housing 2.

Referring to FIG. 3D, shown therein is a magnified view of a portion F3D indicated in FIG. 3A showing a third displacement limiting device 360 in the form of a ratchet 224 on the inner surface 310 of the first tubular member 210, the ratchet 224, capable of irretractably receiving the grooved proximal end of piston 4, by making metal-to-metal contact between the ratchet 224 and the grooved outer surface 316*a* of piston 4 thereby permanently locking piston 4 to the first tubular member 210. It is noted that the ratchet 224 is shown, from the point of the viewer, in a more receded cross-sectional plain, as the ratchet 224 represents a threaded inner surface 310 of the first tubular member 210. In other embodiments, the third displacement limiting device may be constructed using a tooth or several teeth capable of irretractably receiving the proximal end of piston 4, by making metal-to-metal contact between the ratchet 224 and the outer surface 316*a* of piston 4 thereby permanently locking piston 4 to the tubular member 210. In yet other embodiments other locking structures capable of irretractably placing the assembly in a port closed position may be used, including for example the locking structure hereinafter described and shown in FIG. 15C.

In another embodiment, the displacement limiting device 350 comprises a spring assembly comprised of a plurality of springs, wherein the plurality of springs is circumferentially placed about a piston, and wherein the diameter of each spring is sufficiently small so that each spring fits between the outer surface of the piston and the inner surface of the central housing. This embodiment can be an alternate to an embodiment comprising a spring coiled about a piston as hereinbefore described (see, for example: FIGS. 5A-5B).

Figure 16A:
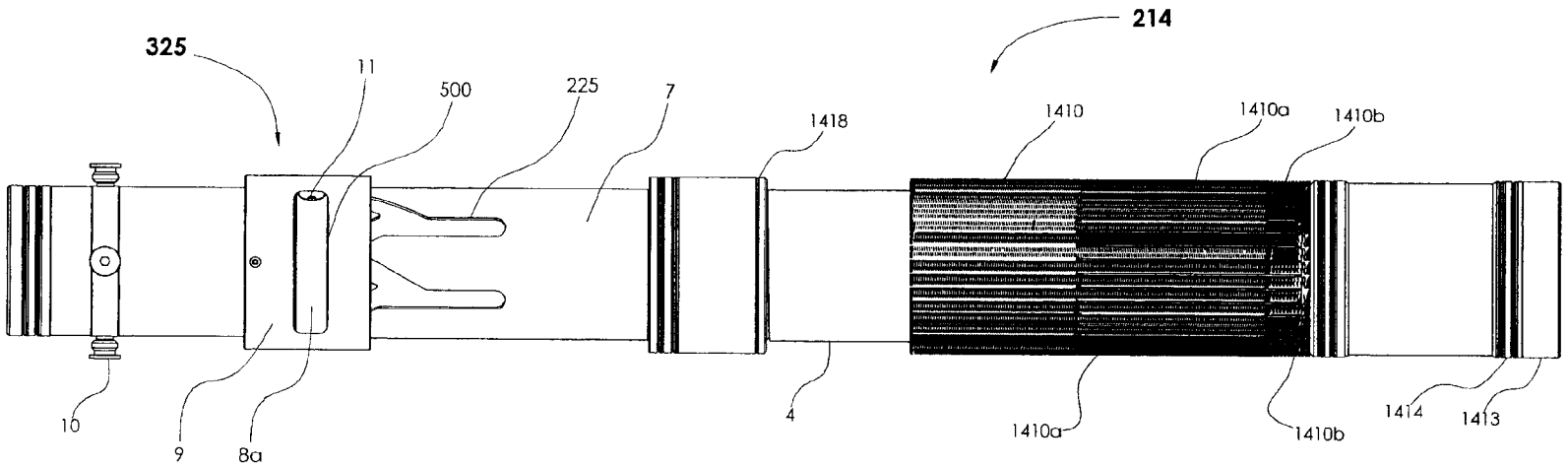
FIGS. 16A-16B depict side views of an embodiment of one of the tubular members of the tubular valve assembly of the present disclosure, including assembled displacement limiting devices (FIG. 16A) and one partially disassembled displacement limiting device (FIG. 16B).
Figure 16B:
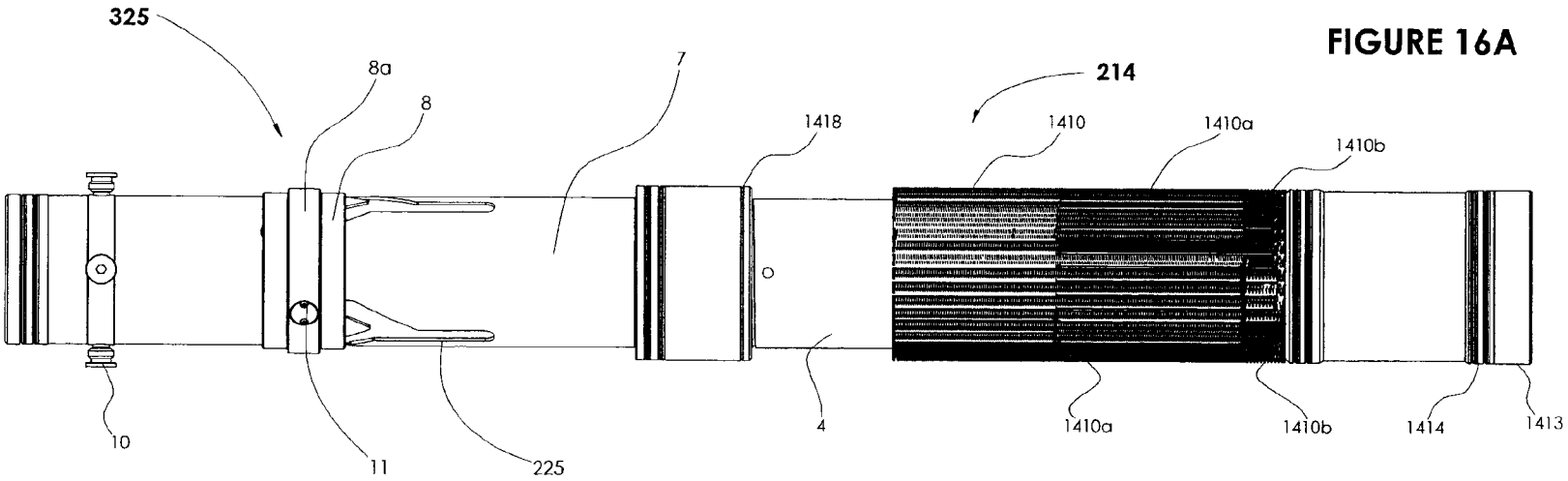
Figure 17A:
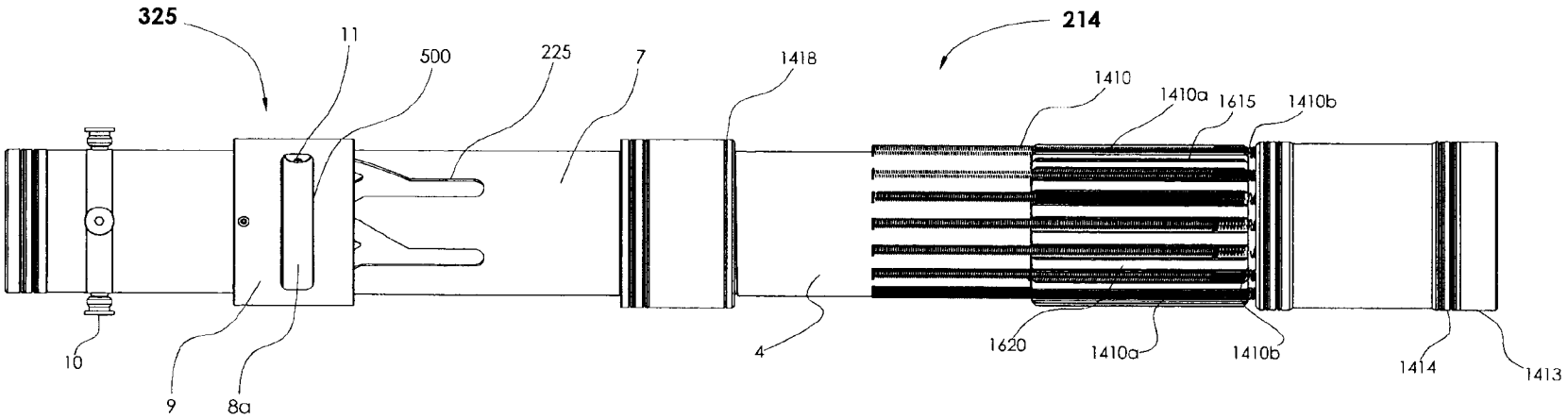
FIGS. 17A-17B depict side views of an embodiment of one of the tubular members of the tubular valve assembly of the present disclosure, including assembled displacement limiting devices (FIG. 17A) and two partially disassembled displacement limiting devices (FIG. 17B).
Figure 17B:
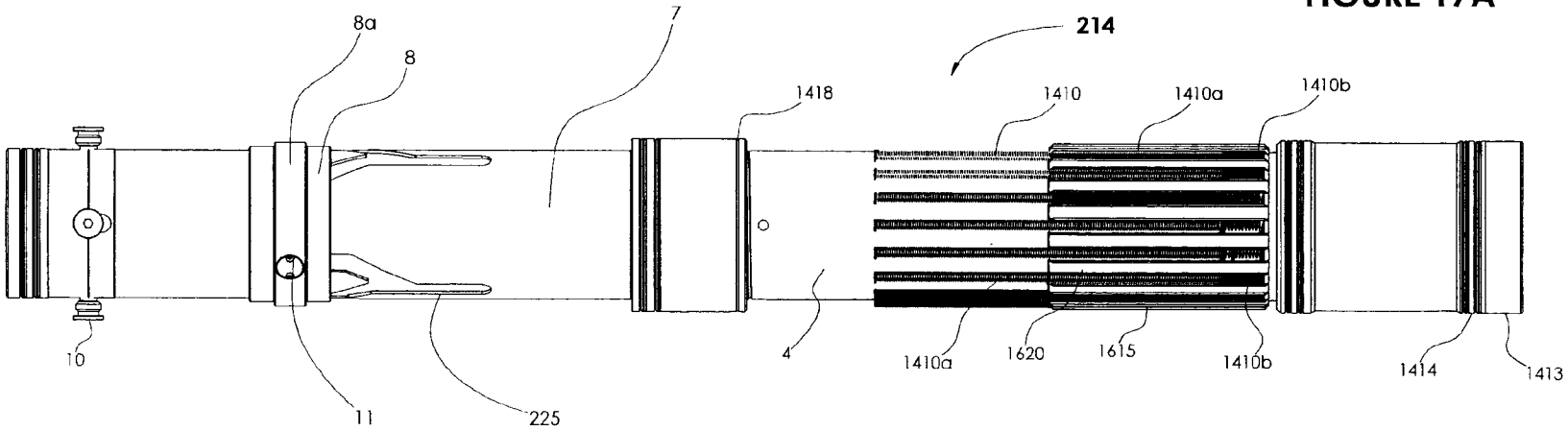

Referring now to FIGS. 16A-16B, shown therein are side views of the second tubular member 214 of such an alternate embodiment. In the embodiment shown in FIGS. 16A-16B, a spring assembly 1410, comprised of a plurality of springs 1410*a*; 1410*b* is circumferentially placed about the piston 4 and each spring is placed within a spring dislocation prevention structure (see further: FIGS. 17A-17B). The diameter of each individual spring 1410*a*; 1410*b* is sufficiently small so that each individual spring 1410*a*; 1410*b* fits between the outer surface of the piston 4 and the inner surface of the central housing (not shown). The pitch of the springs comprising the spring assembly 1410 may vary. All springs may have the same length and pitch or springs with two or more different lengths and pitches can be used. Thus, for example, springs with a shorter and longer pitch may be alternated about the piston 4. In another embodiment, a portion of the length of a spring may have a certain pitch and another portion of the length of the spring may have a different pitch. Such different portions may form one spring or be separated from one another. Thus, for example, referring to FIGS. 16A-16B, the springs 1410*a* within the spring assembly 1410 have a shorter pitch than the springs 1410*b* within the spring assembly 1410, and the springs 1410*a* and 1410*b* are separate from one another. The amount of springs can vary. Thus in different embodiments, at least 10, 20, 30, 30, 40, 50 or 60 springs can be used. The spring rate per spring can vary but collective spring rates can vary from about 900 lbs/inch to about 3,600 lbs/inch. Thus, for example, in one embodiment, a spring assembly having 36 springs and each spring having a spring rate of 50 lbs/spring, providing an assembly having 1,800 lbs/inch, can be assembled.

Referring now to FIGS. 17A-17B, shown therein is substantially the same view of the second tubular member 214 as in FIGS. 16A-16B, provided however that, alternating springs have been removed, for the purpose of clarity of illustration. In order to prevent lateral dislocation of the springs 1410*a*; 1410*b*, the springs are separated from one another by a plurality of longitudinally extending ribs 1615 elevating from the outside surface of the piston 4. Formed between the ribs 1615 are a plurality of longitudinally extending gutters 1620, each gutter 1620 holding a spring.

In the embodiment shown in FIGS. 16A and 17A, the circumferential elevation 8*a* of the lug ring 8 is visible through a circumferentially extending aperture 500 in the lug ring retainer 9. In the side view shown in FIG. 16B and FIG. 17B, the lug ring retainer has been removed exposing the lug ring 8. Lug ring 8 further comprises lug pin 11 attached to the lug ring 8 engaged in a generally longitudinally extending profile 225 representing a recess in the outer surface 316*b* of the piston 7. Piston 7, when pressure is applied thereto in a longitudinal direction (as hereinafter described), can displaceably move in a longitudinal direction relative to the lug ring retainer 9. Such movement results in lug pin 11 moving through profile 225. The shape of the longitudinally extending profile 225 may vary in different embodiments. Two example profiles 225*a* (a Y-shaped profile) and 225*b* (a double Y-shaped profile) are hereinafter described and shown in FIGS. 11A-11B and FIGS. 12A-12B, respectively.

Referring now to FIGS. 6A-6B, FIGS. 7A-7B, FIGS. 8A-8B, FIGS. 9A-9B, and FIGS. 10A-10B shown therein are a series of cross-sectional views of the embodiment of the tubular cementing assembly 108 shown in FIG. 2A representing different actuations of the pistons 4 and 7 when the tubular cementing assembly 108 has been inserted in a wellbore, and an annular space 106 between the outer surface of the tubular cementing assembly 108 and the wellbore wall 118 is formed and the tubular cementing assembly 108 is operated therein. The cross sectional views shown in each of FIGS. 6A-6B, FIGS. 7A-7B, FIGS. 8A-8B, FIGS. 9A-9B, and FIGS. 10A-10B represent a section taken through a plain generally through the central axis Ax of the tubular cementing assembly 108.

Figure 6A:
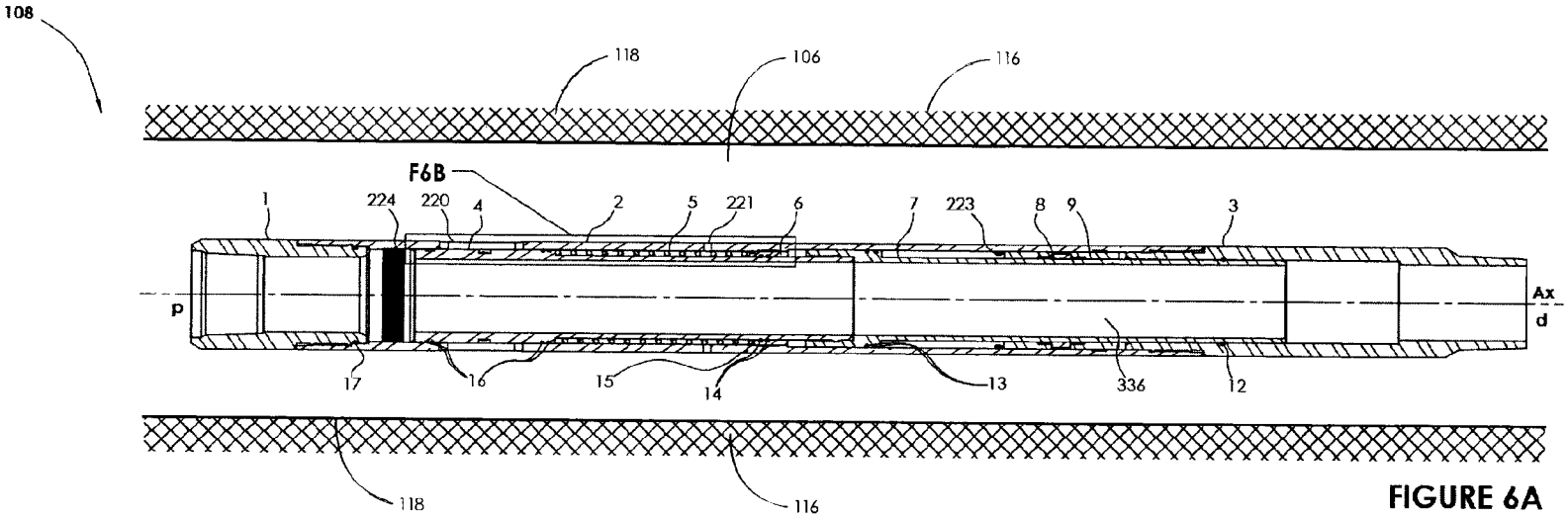
FIGS. 6A-6B depict a longitudinal cross-sectional view of a tubular valve assembly according to an embodiment of the present disclosure (FIG. 6A) and a detailed magnified view of a portion F6B thereof with the valve system depicted prior to actuation, in a closed position (FIG. 6B).
Figure 6B:
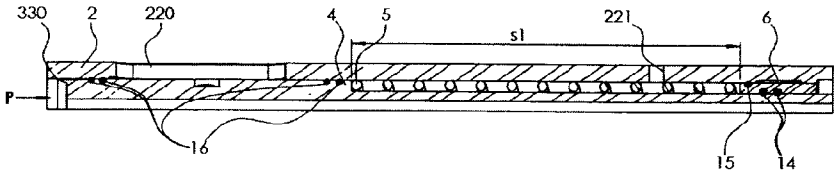

Referring further to FIGS. 6A-6B, wherein FIG. 6B represents a magnified view of a portion F6B indicated in FIG. 6A, an example of the tubular cementing assembly 108 is shown in a closed position in which the piston 4 is generally positioned proximally, so that the piston 4 blocks the flow of fluids through ports 220, between the annulus 106 and the inner passage 336. Displacement of the piston 4 may be attained by a variety of means, but when integrated in a tubular string for a cementing completion sufficient fluid pressure P against surface 330 of piston 4, such as provided by sufficient fluid flowing through the tubular string in from the proximal end p of a tubular string to the distal end d of the tubular string in which the tubular cementing assembly 108 has been integrated. It is noted that when reference herein is made to a fluid pressure P, such fluid pressure P may include any differential pressure supplied by any fluid, including water and completion fluids, and further including pressure P supplied by cement slurry, provided by the communication of such fluids through a tubular string, for example by a fluid pumping system operated above ground.

The configuration shown in FIGS. 6A-6B uses valve control devices to control the displacement of the piston 4. The valve control devices may be, for example shear pins 10, (shown in e.g. FIG. 4 and FIGS. 2A-2B), rupture discs or any other devices that respond to the application of a certain pressure differential.

Figure 11A:
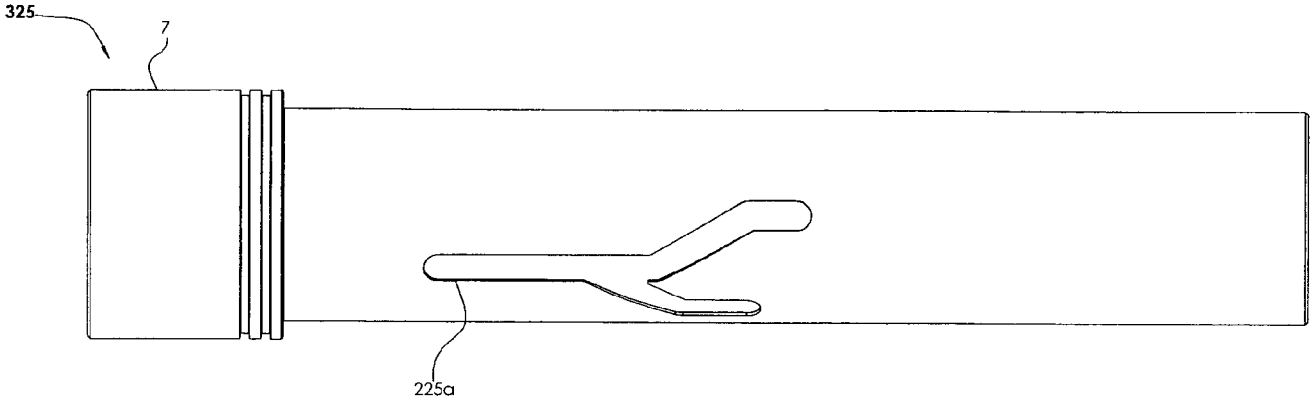
FIGS. 11A-11B depict a side view (FIG. 11A) and a top view (FIG. 11B) of an embodiment of a portion of one of the tubular members of the tubular valve assembly in accordance with the present disclosure.
Figure 11B:
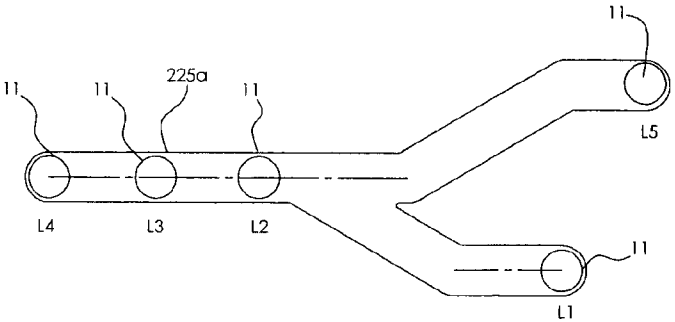

The tubular cementing assembly 108 is initially held in its first closed position, referred to herein as c1, by shear pins 10, to run the tubular cementing assembly 108 into the wellbore and install it therein. When it is desirable to initiate a cementing operation, fluid pumped down the wellbore increases pressure in the inner passage 336 to achieve a pressure differential across the piston 4 and a downward actuating force exerted on the surface 330, thereby shearing the shear pins 10 and displacing the piston 4 towards the distal end d. Fluid actuation may be achieved by water or completion fluids, for example in operational embodiments wherein it is desirable to condition the wellbore. With respect to the first displacement limiting device 350, a spring 5 is coiled about piston 4 in chamber 324, and in some embodiments will have its general unconstrained relaxed length s1 although in other embodiments the spring 5 may be placed in chamber 324 in a more or less compressed form. Referring to FIGS. 11A-11B now, in reference to the second displacement limiting device 325, shown therein is an outside view of the exterior surface of the piston 7 with profile 225*a* (FIG. 11A), and a projected top view of profile 225*a* (FIG. 11B). In these views it may be seen that lug pin 11 engages with profile 225*a* and can be displaced or moved relative to profile 225*a* between several lug positions L1, L2, L3, L4 and L5 relative to the profile 225*a*. When the tubular cementing assembly 108 is configured in its initial non-actuated closed position, the lug pin 11 is positioned in position L1.

Figure 7A:
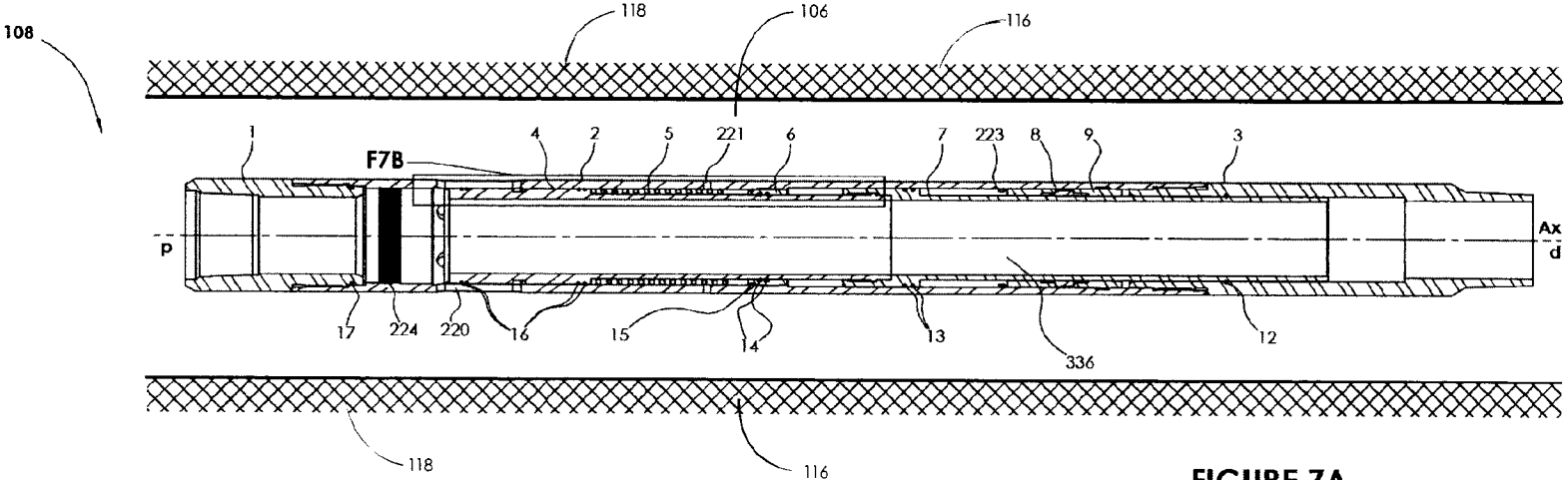
FIGS. 7A-7B depict a longitudinal cross-sectional view of a tubular valve assembly according to an embodiment of the present disclosure (FIG. 7A), and a magnified view of a portion F7B thereof with the valve system depicted in a partially opened position (FIG. 7B).
Figure 7B:
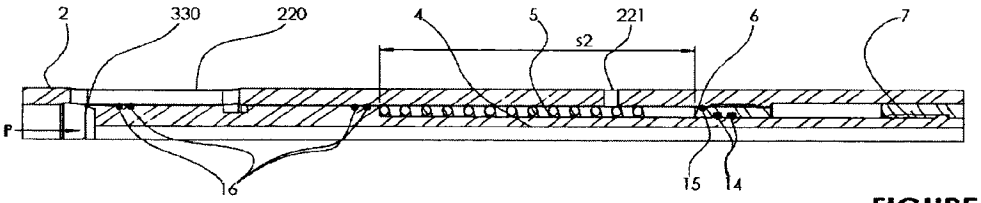

Referring further now to FIGS. 7A-7B, wherein FIG. 7B represents a magnified view of a portion F7B indicated in FIG. 7A, an example of the tubular cementing assembly 108 is shown in a first partially opened position, following the application of fluid pressure P and breakage of the shear pins 10 after which piston 4 has been displaced from its first closed position c1 shown in FIGS. 6A-6B to a first partially open position, referred to herein as c2. Fluid communication, including cement slurry communication, between the inner passage 336 and the annulus 106 via ports 220 is now permitted or allowed). Furthermore, the spring 5 coiled about the piston 4 in chamber 324 is now compressed by pressure applied by the piston 4 to the spring 5 compressing the spring 5 against the collar 6 of the displacement limitation device 350. Thus, s2, is shorter in length than s1, and the volume of chamber 324 is reduced. Together with displacement of the piston 4, the piston 7 is displaced distally. As used herein, s1, s2, s3 and s4 refer to the length of the spring 5, when generally unconstrained and non-compressed s1, partially compressed s2 and s3 and generally fully compressed s4. Thus when sufficient fluid pressure is applied to piston 4, spring 5 compresses, and when thereafter the pressure is sufficiently diminished spring 5 decompresses, thereby actuating retraction of piston 4. As will be clear to those of skill in the art, the spring rate, i.e. the amount of pressure that is sufficient to compress a spring by a unit length, may be varied depending on the spring material, as well as the number of coils selected and can thus be varied in accordance with the operational requirements of the tubular cementing assembly 108. In general, operable ranges include spring rates ranging from, for example, about 900 lbs-3,600 lbs/inch, and in specific embodiments, a spring rate of approximately 1,800 lbs/inch can be used.

Referring to FIG. 11B and the second displacement limiting device 325, the displacement of the piston 7 to the first open position c2 results in a rotation of lug ring 8 (not shown) and displacement of lug pin 11 to position L2.

Figure 8A:
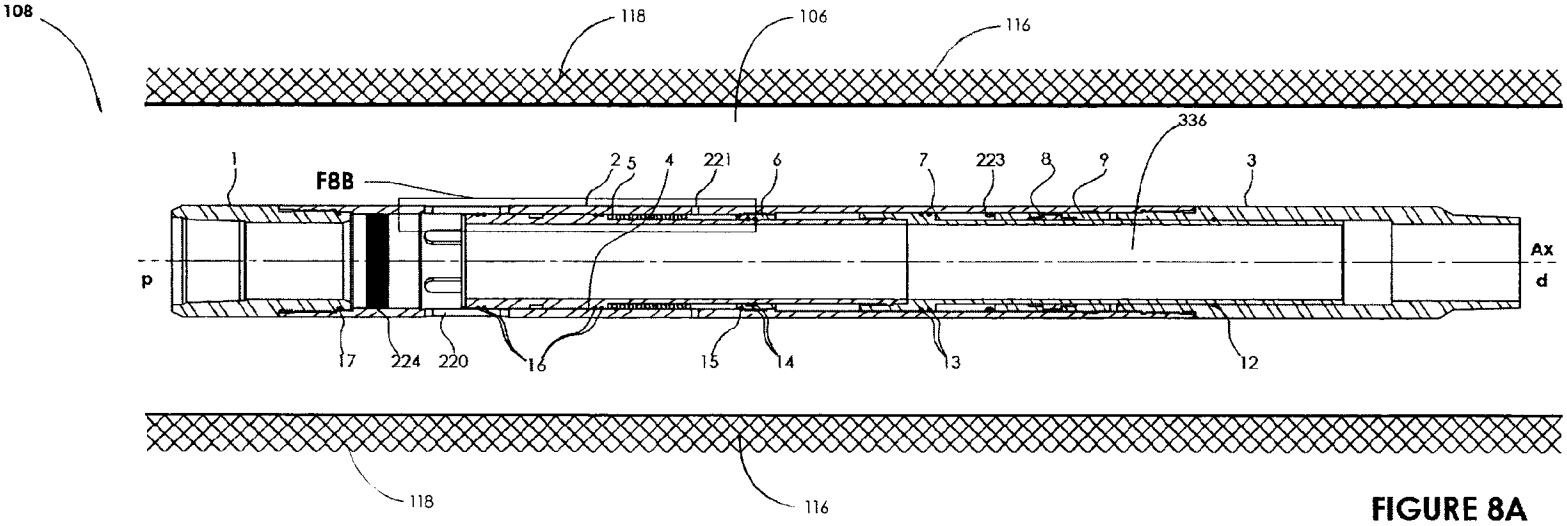
FIGS. 8A-8B depicts a longitudinal cross-sectional view of a tubular valve assembly according to an embodiment of the present disclosure (FIG. 8A), and a magnified view of a portion F8B thereof with the valve system depicted in another further partially opened position (FIG. 8B).
Figure 8B:
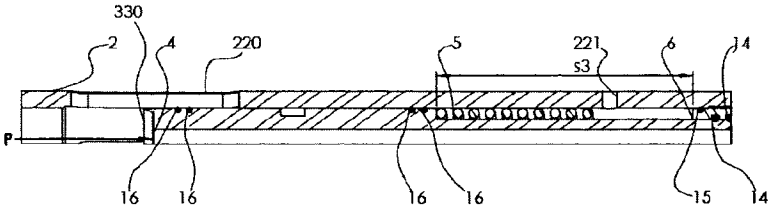

Referring further now to FIGS. 8A-8B, wherein FIG. 8B represents a magnified view of a portion F8B indicated in FIG. 8A, an example of the tubular cementing assembly 108 is shown in a second partially opened position, referred to herein as c3, following the continued application of pressure P, after which piston 4 has been displaced from the first partially open position c2 shown in FIGS. 7A-7B, to a second partially open position c3, opening the tubular cementing assembly 108 further. Fluid, including cement slurry, communication between the inner passage 336 and the annulus 106 via ports 220 is now further increased. Furthermore, the spring 5 coiled about the piston 4 in chamber 324 is now further compressed by pressure applied against collar 6 of displacement limitation device 350. Thus, s3, the length of the partially compressed spring, is shorter in length than s2, and the volume of chamber 324 is further reduced. Together with further displacement of the piston 4, the piston 7 is further distally displaced. Referring to FIG. 11B, the displacement of the piston 7 to the second partially open position c3 results in a rotation of the lug ring 8 (not shown) and displacement of the lug pin 11 to position L3.

Figure 9A:
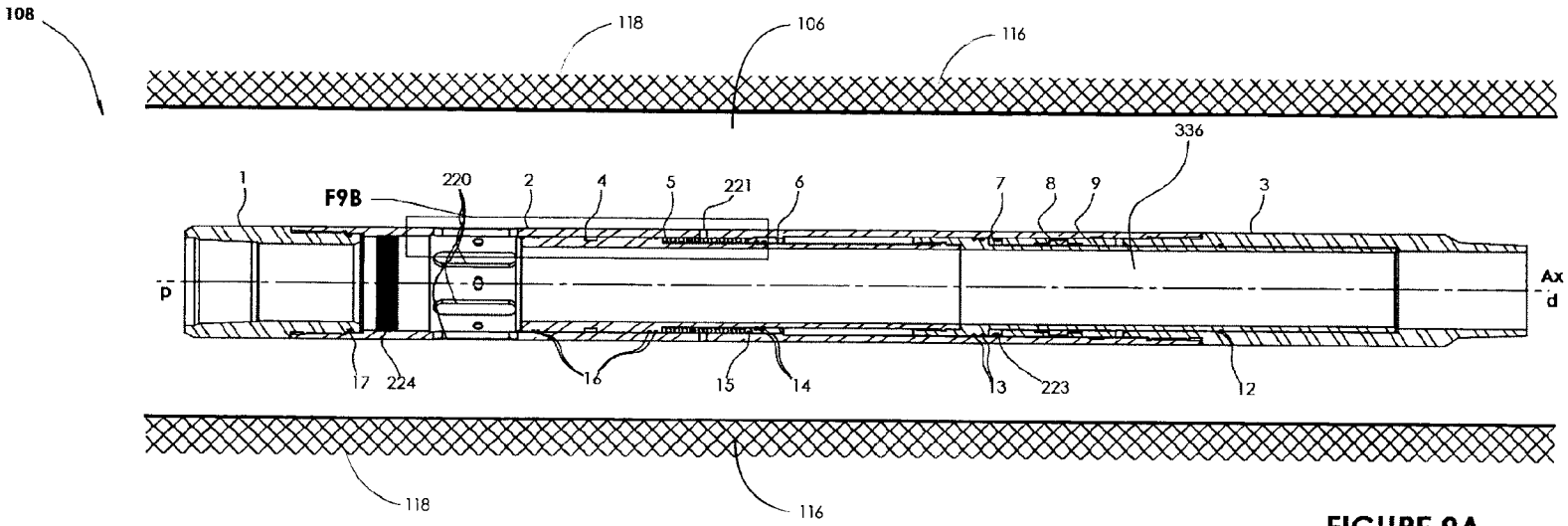
FIGS. 9A-9B depicts a longitudinal cross-sectional view of a tubular valve assembly according to an embodiment of the present disclosure, and a magnified view of a portion F9B thereof with the valve system depicted in a fully opened position (FIG. 9B).
Figure 9B:
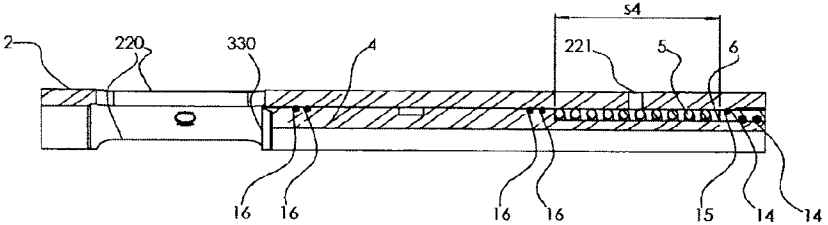

Referring further now to FIGS. 9A-9B, wherein FIG. 9B represents a magnified view of a portion F9B indicated in FIG. 9A, an example of the tubular cementing assembly 108 is shown in a fully open position, referred herein as c4, following the continued application of pressure P, after which the piston 4 has been displaced from its second partially open position c3 shown in FIGS. 8A-8B to a third fully open position c4 opening the tubular cementing assembly 108 fully. Maximal fluid, including cement slurry, communication between the inner passage 336 and the annulus 106 via ports 220 is now permitted. Furthermore, the spring 5 coiled about the piston 4 in chamber 324 is now maximally compressed by pressure applied against the collar 6 of the displacement limitation device 350. Thus s4 is shorter in length than s3, and the volume of chamber 324 is further reduced to be generally entirely occupied by the spring 5. In this compressed position, the collar 6 prevents further displacement in the axial direction of the piston 4, even when pressure P continues to be applied. Together with further displacement of the piston 4, the piston 7 is fully displaced distally.

Referring to FIG. 11B, the displacement of the piston 7 to the fully open position c4 results in displacement of the lug pin 11 to position L4. When in position in L4, the lug pin 11 presses against a proximal end of recess 225*a*, preventing further movement in the distal direction, even when the fluid pressure P continues to be applied. Thus, the tubular cementing assembly 108 of the present disclosure comprises two displacement limiting devices 350 and 325, each functioning in a different manner, preventing displacement in the distal direction of pistons 4 and 7, respectively, beyond a position providing for a fully opened position of the tubular assembly 108, thereby providing a contingency in the event of failure of one or the other displacement limiting devices 350 or 325.

Figure 10A:
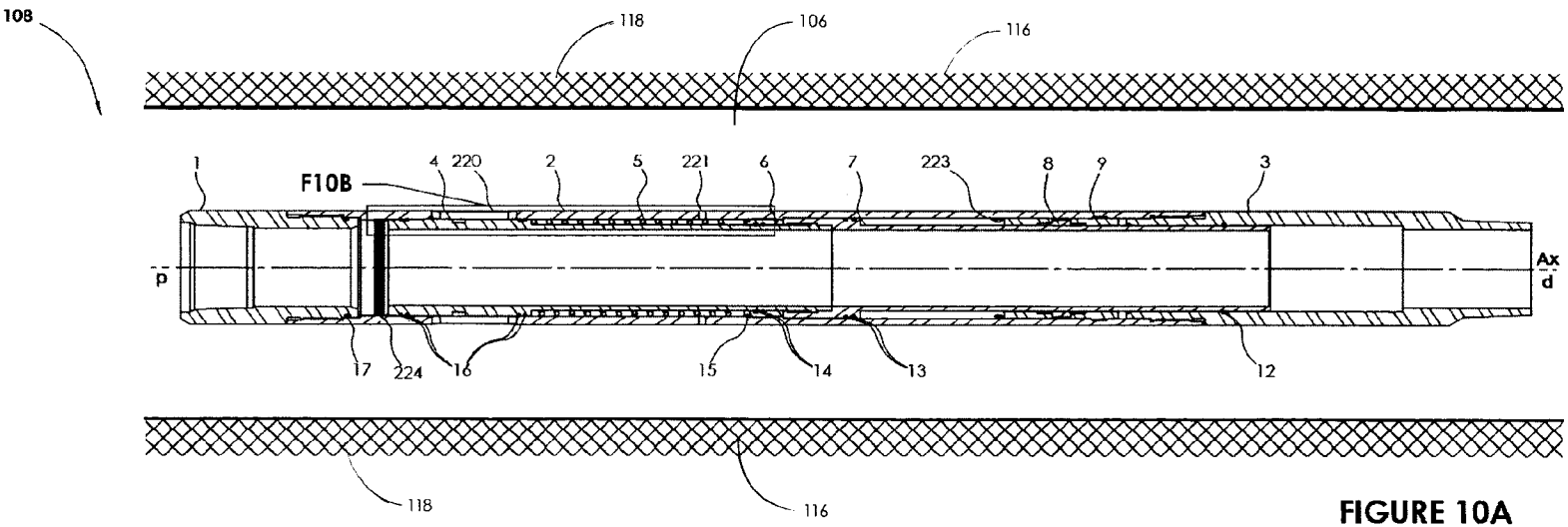
FIGS. 10A-10B respectively depict a longitudinal cross-sectional view of a tubular valve assembly according to an embodiment of the present disclosure, and a magnified view of a portion F10B thereof with the valve system depicted in a subsequent closed position.
Figure 10B:
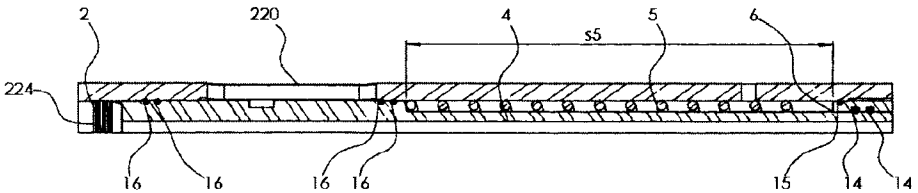
Figure 13A:
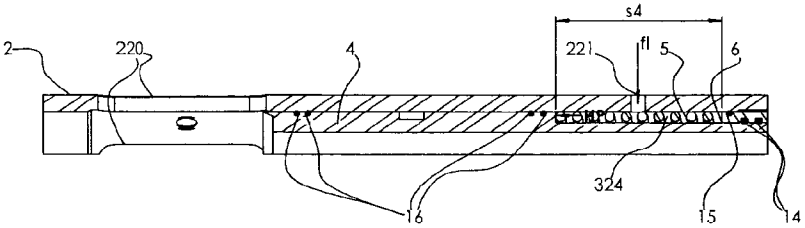
FIGS. 13A-13B depict a longitudinal cross-sectional view of portions of a tubular valve assembly according to an embodiment of the present disclosure, with the valve system depicted in a fully opened position. Shown are a portion comprising a first displacement limiting device (FIG. 13A) and a portion comprising a second displacement limiting device (FIG. 13B).
Figure 13B:
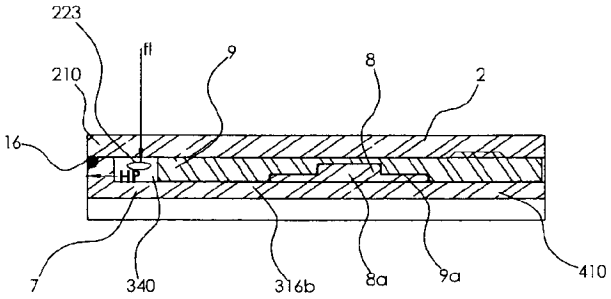

Referring further now to FIGS. 10A-10B, wherein FIG. 10B represents a magnified view of a portion F10B indicated in FIG. 10A, an example of the tubular cementing assembly 108 is shown in a fifth fully closed position, referred to herein as c5, in which the tubular cementing assembly 108 has already been opened in response to pressure P and is now fully closed. Such closure is generally desirable when cementing operations are completed. Pistons 4 and 7 are displaced and retracted starting from, for example, a partially open position such as those represented by c2 or c3, shown in FIGS. 7A-7B and FIGS. 8A-8B, respectively, or starting from a fully open position c4 an example of which is shown in FIGS. 9A-9B, to a fully closed position c5. Sufficient release of pressure P when the tubular cementing assembly 108 is positioned or configured in its c4 position (as shown in FIG. 9A, and as shown in the detailed view of portions FIG. 13A (piston 4) and FIG. 13B (piston 7), results in a differential hydraulic pressure HP and fluid flow fl from the annulus via the apertures 221 and 223, into chambers 324 and 340, respectively, with each chamber expanding in volume and communicating pressure to pistons 4 and 7, respectively. Furthermore, upon the release of sufficient pressure P, a compressed spring 5 is actuated, lengthening from s4 to s1. The combined actuation by hydraulic pressure and mechanical actuation displaces and retracts pistons 4 and 7 in the proximal longitudinal direction. The retraction of piston 4 in the proximal direction results in a closing of the ports 220 and an engagement of the proximal portion of piston 4 with the ratchet 224, irretractably locking piston 4 and securing the ports 220 in a closed position. Referring to FIG. 11B, the displacement and retraction of the piston 7 to the third fully closed position c5 results in a rotation of the lug ring 8 (not shown) and displacement of the lug pin 11 to position L5. When in position L5, the lug pin 11 presses against the distal end of the recess 225*a*, preventing further movement in the distal direction of the piston 7, even with continued hydraulic pressure HP from fluid flow fl. In a further embodiment, profile 225*a* may comprise a further extension in a general radial direction of the L5 position forming a hook. In such an embodiment, the lug pin 11 is further secured when positioned in its L5 position.

Thus the tubular cementing assembly 108 of the present disclosure comprises two displacement limiting devices 350 and 325, each functioning in a different manner, preventing displacement in the proximal direction of pistons 4 and 7, respectively, once the tubular cementing assembly 108 achieves a fully closed position, thereby providing a contingency in the event of failure of one or the other displacement limiting devices 350 or 325.

Figure 12A:
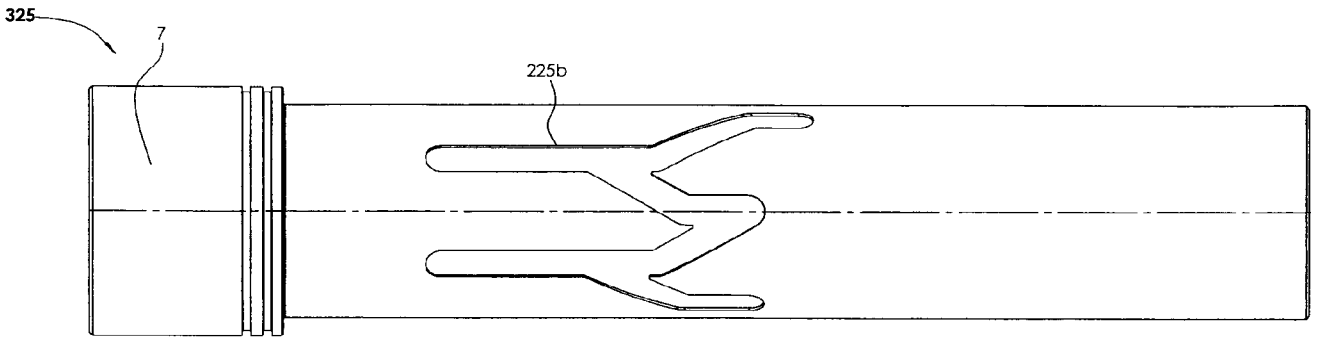
FIGS. 12A-12B depicts a side view (FIG. 12A) and a top view (FIG. 12B) of another embodiment of a portion of one of the tubular members of the tubular valve assembly in accordance with the present disclosure.
Figure 12B:
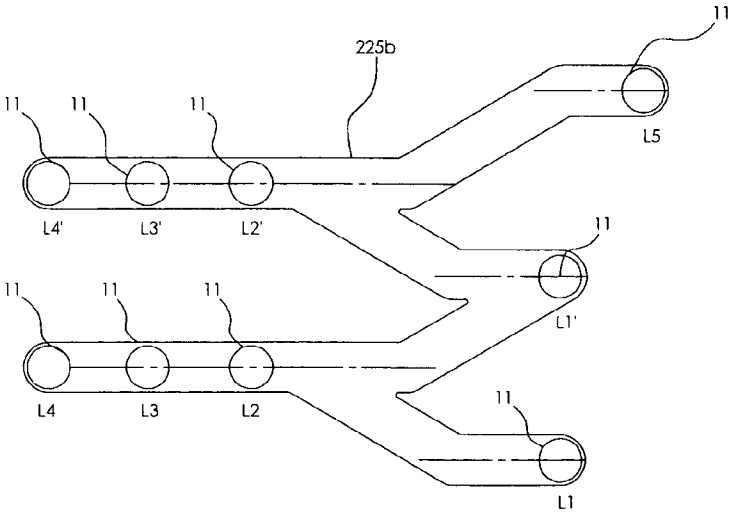

In another embodiment, the second displacement limiting device 325, has an alternate recess profile. Referring to FIGS. 12A-12B, shown therein is an outside view of the exterior surface of piston 7 with profile 225*b* (FIG. 12A), and a projected top view of profile 225*b* (FIG. 12B). In this view it may be seen that lug pin 11 can move or be displaced between several positions L1, L2, L3, L4, L1', L2', L3', L4' and L5 relative to the profile 225*b*. In this embodiment, it is possible for a cementing operation to be experiencing a full or almost full loss of pressure P, resulting in closure of the ports 220, alteration from configuration c4, c3 or c2 of the tubular cementing assembly 108 to a c1 configuration, and movement of the lug pin 11 from position L4, L3, or L2 to L1'. Such alteration in configuration does not result in engagement of piston 4 with the ratchet 224, as further axial movement of the pistons 4 and 7 in the proximal direction from general c1 configuration is prevented by the lug pin 11 being in the L1' position. Thus, in an operation experiencing a full or near full loss of pressure P, in this embodiment, pressure P can be reapplied, resulting in re-opening of the ports 220, alteration of the tubular cementing assembly 108 from general c1 configuration to configuration c2, c3 and/or c4 and movement of the lug pin 11 from position L1' to positions L2', L3' or L4'. Thereafter, ports 220 may be partially closed or fully closed, as hereinbefore described, resulting in alteration of the configuration of the tubular cementing assembly 108 from c4, c3 and/or c2 and when desirable to c5, and the lug pin 11 from L4', L3' or L2', and, when desirable, to L5. Thus, this embodiment provides for a contingency in the event of a full or near full loss of fluid pressure P in the tubular string in the distal direction is experienced, e.g. as a result of cement pump failure.

Referring now to FIGS. 15A-15F, wherein FIG. 15B-15F represent magnified views of a portion F15B, F15C, F15D, F15E and F15F indicated FIG. 15A, shown therein are cross-sectional views of an alternate embodiment of the tubular cementing assembly 108, namely the embodiment shown in FIG. 14A. The cross-sectional view shown in FIG. 15A represents a section taken through a plain generally through the central axis Ax of the tubular cementing assembly 108. In FIG. 15A, proximal end p and distal end d are indicated. The first tubular member 210 having an outer surface 212 and an inner surface 310 is shown, as are the central housing 2, comprising first and second parts, 2*a* and 2*b*, respectively, connected by linkage 1450 as well as tubular extensions 1 and 3 of the first tubular member 210, and ports 220 and apertures 223 and 221 therein. Further shown is a second tubular member 214 having an outer surface 316, an inner surface 318 and a wall 410 together forming a longitudinal tubular bore or passage 336 and moveably or displaceably inserted in an axial direction inside the first tubular member 210. The tubular cementing assembly 108 is shown in a port 220 closed position. The second tubular member 214 consists of a distally positioned piston 4, having an outer surface 316*a* and inner surface 318*a* (see: FIG. 15C) and a wall 410*a*, and a proximally positioned piston 7, having an outer surface 316*b* and an inner surface 318*b* (see: FIG. 15B), and a wall 410*b*. Distally positioned piston 4 is further comprised of molded seal sleeve 1414 comprising bonded seals that act to seal metal-to-metal surfaces, held by spring piston cap 1413, which has a fluid pressure P actuatable surface 330. Additionally, proximally positioned piston 7 is actuatable by fluid pressure P acting on fluid actuatable surface 330*b* through aperture 1401 (see: FIG. 15F). It is noted that, in contrast to the embodiment shown inter alia in FIGS. 3A-3D, displacement of the second tubular member 214 within the first tubular member 210 in this embodiment upon exertion of a sufficient fluid pressure P upon the surface area 330 of piston 4 proceeds in the proximal direction. Conversely, retraction of the second tubular member 214 upon a subsequent sufficient reduction in pressure, proceeds in distal direction. The proximal end of the piston 4 is linked to the distal end of piston 7, through linkage 322.

In the embodiment shown in FIG. 15A, the proximal end of the distally positioned piston 4 fits into a widening portion at the distal end of proximally positioned piston 7. Linkage can be provided by a screw thread optionally combined with sealing O-rings or any other suitable attachment device capable of securing piston 4 to piston 7. The embodiment shown herein further comprises several apertures 221 and 223 providing permanent fluid communication between the outer surface 212 and the inner surface 310 of the first tubular member 210. When installed in a fluid filled annulus, apertures 221 provide permanent fluid communication between the exterior of the first tubular member 210 and piston 4. Similarly, apertures 223 provide permanent fluid communication between the exterior of the first tubular member 210 and the piston 7.

In general, in accordance herewith, the first tubular member comprises at least one aperture providing permanent fluid communication between the exterior of the first tubular member 210 and the proximally positioned piston 4, and at least one aperture providing permanent fluid communication between the exterior of the first tubular member and the distally positioned piston. In other embodiments, the first tubular member comprises 2, 3, 4, 5, 6, 7, 8, 9, 10 or more apertures providing permanent fluid communication between the exterior of the first tubular member and the proximally positioned piston and/or 2, 3, 4, 5, 6, 7, 8, 9, 10 or more apertures providing permanent fluid communication between the exterior of the first tubular member 210 and the distally positioned piston 7.

Referring now to FIG. 15B, shown therein is the accordingly referenced magnified view of a portion F15B of the tubular cementing assembly 108 indicated in FIG. 15A, showing the linkage between the central housing 2*a* and the first tubular extension 1, which includes a threaded surface 1452 linkage and a set screw 1405. Also shown in FIG. 15B are the lug ring 8 and the lug ring retainer 9.

Referring now to FIG. 15C, shown therein is the accordingly referenced magnified view of a portion 15C of the tubular cementing assembly 108 indicated in FIG. 15A showing a portion of a displacement limiting device 350 further referenced inter alia in FIGS. 16A-16B. Shown is a spring assembly 1410 comprising two springs, a first spring having a shorter pitch 1410*a*, and a second spring having a longer pitch 1410*b*, located in chamber 324, which can be accessed by fluid present in the annular space through aperture 221. Further shown are spring resistant surfaces 1660*p* and 1660*d*. It is noted that the diameter of the spring assembly 1410 is sufficiently small so that it fits into the chamber 324 between the outside surface 316*a* of the piston 4 and the inside surface 310 of the central housing 2*b*.

Referring now to FIG. 15D, shown therein is the accordingly referenced magnified view of a portion F15D of the tubular cementing assembly 108 indicated in FIG. 15A, showing the surface area 330 of the spring piston cap 1413 of piston 4. Further shown in FIG. 15D are sealing O-rings 1409, which generally seal various metal-to-metal surfaces.

As hereinbefore noted, the tubular cementing assembly 108, may comprise various valve control devices, including shear pins and rupture discs. Referring now to FIG. 15E, shown therein is the accordingly referenced magnified view of a portion F15E of the tubular cementing assembly 108 indicated in FIG. 15A, which generally shows a valve control device in the form of a rupture disc 1412. The rupture disc 1412 prevents actuation of the piston 4 below a threshold fluid pressure sufficient to burst the rupture disc 1412. Rupture discs having specific threshold fluid pressures may be selected and adjusted depending on operational requirements, as will be understood by those of skill in the art.

It is noted that the embodiment shown in FIG. 15A, in addition to rupture disc 1412, comprises shear pins 10, thus illustrating that the tubular cementing device of the present disclosure may comprise two or more different valve control devices.

Referring now to FIG. 15F, shown therein is the accordingly referenced magnified view of a portion F15F of the tubular cementing assembly 108 indicated in FIG. 15A, showing a third displacement limiting device in the form of a non-contiguous lock ring 1416 and lock ring cavity 1418, capable of irretractably receiving the non-contiguous lock ring 1416. The non-contiguous lock ring 1416 is generally constructed to be a diametrically expandable spring. Upon closure of the ports 220, the lock ring 1416 moves into the lock ring cavity 1418 and diametrically expands therein, thereby irretractably locking piston 7 to the central housing 2*a* and thus to the first tubular member 210. Further shown is proximally positioned piston 7 that is actuatable by fluid pressure P acting on a second fluid actuatable surface 330*b* via inner aperture 1401 through the wall of piston 4 connecting the inner passage 336 to second fluid actuatable surface 330*b* of piston 7. The inner aperture 1401 in combination with the second actuatable surface 330*b* allows for pistons 4 and 7 to substantially retain their position, and for the port 220 to remain in the open position, in the event of a brief temporary reduction of pressure on actuatable surface 330*a*, for example as a result of a brief reduction in tubular pressure fluid pressure, such as may occur when port 220 opens. Thus, the inner aperture 1401 in combination with the second actuatable surface 330*b* prevents response of the assembly 108 with a piston shift in the event of temporary pressure fluctuations, notably temporary pressure reduction on actuatable surface 330*a*. It is noted that the assembly 108 in different embodiments, may contain one or two or more circumferentially placed inner apertures through the wall of piston 4 connecting the inner passage with additional fluid actuatable surfaces of piston 7.

Figure 18A:
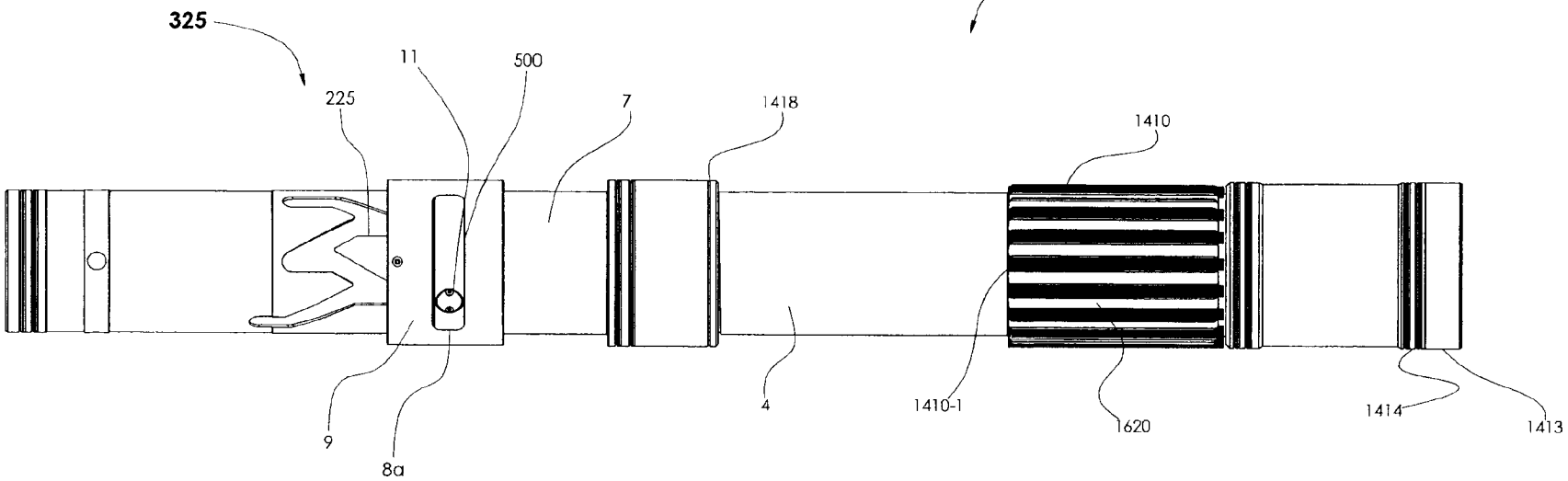
FIGS. 18A-18B depict side views of an embodiment of one of the tubular members of the tubular valve assembly of the present disclosure, including assembled displacement limiting devices (FIG. 18A) and two partially disassembled displacement limiting devices (FIG. 18B).
Figure 18B:
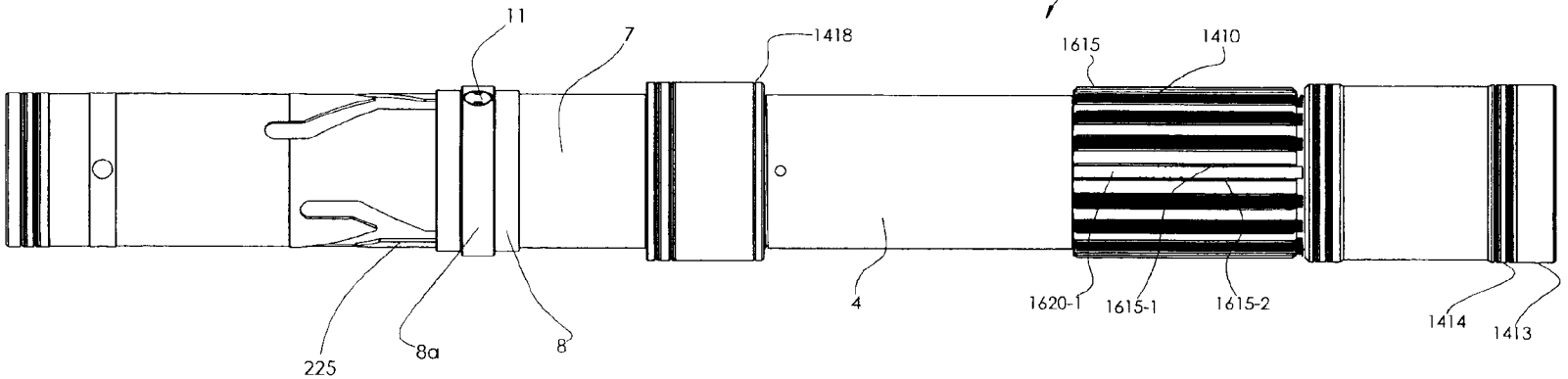

Referring now to FIGS. 18A-18B, shown therein is substantially the same view of the second tubular member 214 as is shown in FIGS. 17A-17B, provided however that the second tubular 214 member is displaced in the proximal direction relative to the first tubular member, thus positioning the tubular cementing assembly in a port open position, as can be appreciated from the movement of the second tubular member 214 relative to the lug ring 8 and the lug ring retainer 9. Displacement of the second tubular member 214 results in a longitudinal compression of the spring assembly 1410 against spring resistant surface 1660*p* formed by a distal portion of the piston 7 (as shown in FIG. 15C). It is noted that for illustration purposes in FIG. 18B, one additional spring 1410-1 has been removed exposing an additional gutter 1620-1, and ribs 1615-1 and 1615-2.

It is an advantage of embodiments hereof comprising a plurality of pistons that differential pressure is independently exerted on each piston, thereby increasing the force generated and rendering the tubular cementing assembly more sensitive to differential pressures than a tubular cementing assembly constructed using a single contiguous piston.

In certain exceptional circumstances, closure of the tubular cementing assembly 108 may not be achieved as desired through a combination of hydraulic and mechanical actuation as hereinbefore described. In such circumstances, closure may be achieved by conveying a mechanical shifting tool into the tubular cementing assembly 108 capable of engaging the second tubular member 214, and displacing it.

It is noted that the pistons 4 and 7 may be displaced between various port partially open and port fully closed positions c2, c3 and c4 any number of times. Thus, in the operation of the tubular cementing assembly 108 of the present disclosure, it is not necessary to maintain a constant pressure P on the piston 4 as cement is flowed through the tubular cementing assembly 108 into the annulus, and the tubular cementing assembly 108 can respond to certain fluctuations in cement pressure, which may occur in different circumstances such as, but not limited to, when conducting a cement flowing operation using a cement pumping system, for example. Variation in pressure P will result in longitudinal and radial engagement of lug pin 11 of the recess positions L2, L3 and L4.

It may be appreciated that the foregoing description of the tubular cementing assembly 108 and configurations thereof, and various alternate embodiments and configurations, provides significant improvements over the prior art. The tubular cementing assembly 108 is capable of reliably and conveniently permitting circulation of cement and other fluids between the flow passage 336 and the annulus 106, is further capable of restricting a circulation of cement and other fluids between the flow passage 336 and the annulus 106, is actuatable in downward and upward directions by fluctuations in fluid pressure, and without requiring a separate mechanical shifting device, and provides a number of contingency aspects to retain the tubular cementing assembly 108 in an open or closed position when desired. The tubular cementing assembly 108 further obviates the need for drill-out of a closing plug or tubular string closure positioned distally from the tubular cementing assembly 108 upon completion of a cementing operation. It is further noted that closure of the tubular cementing assembly 108 is actuated by a force supplied by annular fluid pressure. Closure by a force supplied by annular fluid pressure is preferable over closure by, in the case of the embodiment described in FIG. 3, a downward directed mechanical force, for example, as applied by tubing compression, since depending on the angle in which the cementing assembly is positioned in the wellbore it may be challenging to deliver the appropriate downward mechanical force, and achieve closure, and downward directed mechanical force may be hindered as a result of the cementing assembly making contact with the wellbore wall (differential sticking).

The present disclosure further provides, in one aspect, an embodiment of a method of controlling cement flow from an inner passage 336 of a tubular string 104 to the exterior thereof, the method comprising:

constructing a tubular valve assembly 108 for interconnecting the tubular string 104, the assembly 108 comprising:

a first tubular member 210 having ports 220 through the wall of the tubular member 210;

a second tubular member 214 installed inside the first tubular member 210, and displaceable within the first tubular member 210 from a port closed position in which no fluid communication is allowed between the inner passage 336 and the exterior of the tubular valve assembly 108 to a port open position in which fluid communication is allowed between the inner passage 336 and the exterior of the tubular valve assembly 108;

the second tubular member 214 comprising a piston 4 comprising a first displacement limiting device 350 and a second displacement limiting device 325;

the first tubular member 210 comprising a first fluid aperture 221 and a second fluid aperture 223 allowing for fluid communication between the exterior of the first tubular member 210 and the piston 4 via the first fluid aperture 221 and allowing for fluid communication between the exterior of the first tubular member 210 and the second piston 7 via the second fluid aperture 223;

displacing the second tubular member 214 relative to the first tubular member 210 in a downward direction and opening the ports 220;

supplying a flow of cement slurry through the inner passage 336 of the tubular valve assembly 108, wherein the cement flows between the inner passage 336 of the tubular valve assembly 108 and the exterior of the tubular valve assembly 108 through the ports 220;

reducing the cement slurry flow; and displacing the second tubular member 214 relative the first tubular member 210 in an upward direction by actuating the first displacement limiting device 350 and the second displacement limiting device 325 in an upward direction and closing the ports 220.

The act of displacing the second tubular member in a downward direction may comprise supplying water or a completion fluid at a pressure P that is sufficient to displace the second tubular member 214 relative to the first tubular member 210 in distal direction and open the ports 220. The completion fluid may be, but is not limited, to water, for example. In this manner it is possible to condition the annulus.

The act of reducing the cement slurry flow may further include reducing the pressure P to a pressure level at which the second tubular member 214 is displaced from a fully open position to a partially open position wherein such displacement is hydraulically actuated by fluid pressure provided by annular fluid flow through apertures 221 and 223, and mechanically actuated by the first displacement limiting device 350.

Alternatively, the act of displacing the second tubular member 214 in an upward direction may further be preceded by providing a fluid through the inner passage 336 at a pressure P that is sufficient to maintain the ports 220 in an open position. Such fluid may be water or a completion fluid, for example a completion fluid hindering the setting of the cement in the tubular string.

Alternatively, the act of displacing the second tubular member 214 in an upward direction may further include reducing the pressure P to a pressure level at which at the second tubular member 214 is displaced from a partially or fully open position to a fully closed position wherein such displacement is hydraulically actuated by a differential fluid pressure provided by annular fluid pressure through apertures 221 and 223, and mechanically actuated by the first displacement limiting device 350, and wherein the valve assembly comprises a third displacement limiting device 224 preventing displacement of the second tubular member in the distal direction by the second and third displacement limiting devices 325 and 224.

Alternatively, the act of displacing the second tubular member 214 in an upward direction may further include reducing the pressure P to a pressure level at which at which the second tubular member 214 is displaced from a partially or fully open position to a closed position wherein such displacement is hydraulically actuated by a differential fluid pressure provided by annular fluid pressure through apertures 221 and 223, and mechanically actuated by the first displacement limiting device 350, and wherein upon the re-application of sufficient P that is sufficient to displace the second tubular member 214 relative to the first tubular member 210 in the distal direction, cement ports 220 may open again partially or fully.

Alternatively, the act of displacing the second tubular member 214 in an upward direction may further include reducing the pressure P1 to a first pressure level at which at which the second tubular member 214 is displaced from a partially or fully open position to a closed position wherein such displacement is hydraulically actuated by a differential fluid pressure provided by annular fluid pressure through apertures 221 and 223, and mechanically actuated by the first displacement limiting device 350, and wherein upon the re-application of a second pressure level P2 that is sufficient to displace the second tubular member 214 relative to the first tubular member 210 in the distal direction, the ports 220 may open again partially or fully, and wherein then the pressure level P2 is reduced to a pressure level P3 at which the second tubular member 214 is displaced from a partially or fully open position to a fully closed position wherein such displacement is hydraulically actuated by a differential fluid pressure provided by annular fluid pressure through apertures 221 and 223, and mechanically actuated by the first displacement limiting device 350, and wherein the valve assembly comprises a third displacement limiting device 224 that can be used along with the second displacement limiting device 325 for preventing displacement of the second tubular member in the distal direction.

As has become clear from the foregoing, the tubular valve assembly of the present disclosure may be used to control the flow of cement slurry in a wellbore. In other embodiments, the tubular valve assembly of the present disclosure may be used to control the flow of fluids in a well, such fluids including, but not limited to, water and completion fluids.

Accordingly, in another aspect, the present disclosure provides an embodiment of a process for controlling fluid flow from in an inner passage 336 of a tubular string 104 to the exterior thereof, the method comprising:

constructing a tubular valve assembly 108 for interconnecting the tubular string, the assembly comprising:

a first tubular member having cement ports 220 through a wall of the tubular member 210;

a second tubular member 214 installed inside the first tubular member 210, and displaceable within the first tubular member 210 from a port closed position in which no fluid communication is allowed between the inner passage 336 and the exterior of the tubular valve assembly 108 to a port open position in which fluid communication is allowed between the inner passage 336 and the exterior of the tubular valve assembly 108;

the second tubular member 214 comprising a first interlocking piston 4 and a second interlocking piston 7, the first piston 4 comprising a first displacement limiting device 350 and the second piston 7 comprising a second displacement limiting device 325;

the first tubular member 210 comprising first fluid apertures 221 for allowing fluid communication between the exterior of the first tubular member 210 and the first piston 4 and second fluid apertures 223 for allowing fluid communication between the exterior of the first tubular member 210 and the second piston 7;

the second tubular member 214 being actuatable in a downward direction by sufficient fluid pressure to displace the second tubular member 214 inside the first tubular member 210 from a port closed position to a port open position, until such movement is blocked by the first displacement limiting device 350 and the second displacement limiting device 325; and the second tubular member 214 further being actuatable in an upward direction by a combination of hydraulic pressure and mechanical actuation, the hydraulic pressure being exerted on the outer surface of the assembly 108 via the first apertures 221 and second apertures 223, and the mechanical actuation being provided by the first displacement limiting device 350 to retract the second tubular member 214 inside the first second tubular member 210 from the port open position to the port closed position;

supplying a fluid through the inner passage 336 of the tubular valve assembly 108 at a pressure level that is sufficient to displace the second tubular member 214 relative to the first tubular member 210 in distal direction and open the port at least partially; and then reducing the pressure at which the fluid is provided to displace the second tubular member 214 relative to the first tubular member 210 and at least partially close the port thereby diminishing fluid communication between the inner passage 336 and the exterior of first tubular member 108.

The tubular valve assembly 108 and the methods herein disclosed may be used in conjunction with a wide variety of well completion operations and configurations, some of which are hereinafter further described using at least one example. It is to be clearly understood that other operations and configurations may also be constructed.

As hereinbefore noted, the tubular valve assembly 108 of the present disclosure obviates the need for drill-out operations. Accordingly, in some embodiments, a wellbore may be constructed comprising one or more stimulation fluid ports upward, i.e. in the proximal direction, from the tubular valve assembly of the present disclosure. Such stimulation fluid ports may be constructed in addition to the stimulation fluid ports downward (i.e. in a distal direction) of the tubular valve assembly as shown by an example in FIG. 1. In such construction and configuration, it is possible to stimulate two or more lateral portions of the reservoir rock formation in which the wellbore has been drilled.

Figure 19:
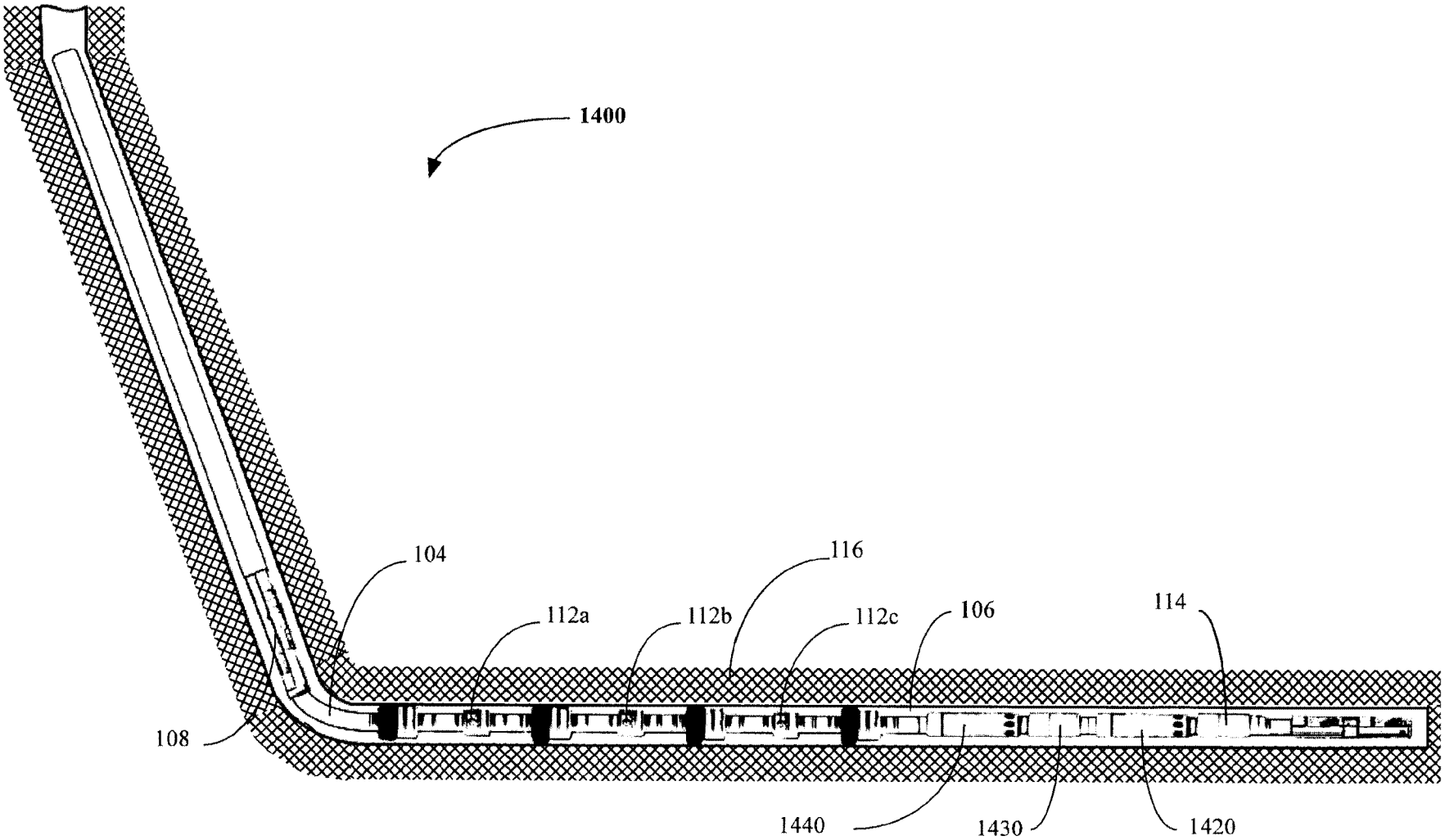
FIG. 19 depicts a plan side view of another example configuration of a wellbore system in which the valve system and methods of the present disclosure may be deployed.

Furthermore, a wellbore may be constructed integrating the tubular valve assembly of the present disclosure and further comprising one or more downward positioned devices that permit the clearing of cement debris through the distal end of the tubular string. Referring to FIG. 19, in one configuration 1400 this may, in one embodiment, be achieved by installation of a low pressure port 1420 at the distal end of a tubular string 104, but proximally to a wellbore isolation valve 114. Upon completion of cementing operations, and with the wellbore isolation valve 114 in a closed position, cement debris may be disposed into the annulus 106 by applying sufficient pressure to the tubular string 104 to open the low pressure port 1420, and flushing cement debris through the low pressure port 1420 into the annulus 106. Upon completion of the flushing operation, a closure device is pumped to a second wellbore isolation valve 1430 to close it. In order to re-initiate fluid stimulation, a high pressure stimulation port 1440 and, optionally, additional stimulation fluid ports 112*c*, 112*b* and 112*a* upward from the second wellbore isolation valve 1430 may be opened and stimulation fluids may be applied to the reservoir rock formation 116 via the high pressure stimulation port 1440 and optional additional stimulation fluid ports 112*c*, 112*b* and 112*a*. In one configuration, the low pressure port 1420 is comprised of a low pressure atmospheric port 1420, actuatable for example by applying fluid pressure against pressure sensitive rupture discs. Upon opening of the low pressure atmospheric port 1420, again with the wellbore isolation valve 114 in a closed position, the tubular string 104 may be flushed. Thereafter, the flow through isolation valve 1430 may be closed. The high pressure stimulation port 1440 and optional stimulation ports 112*c*, 112*b* and 112*a* upward from the low pressure atmospheric port 1420 may then be opened and stimulation fluid may be applied to the reservoir rock formation 116 via the high pressure stimulation port 1440 and the stimulation ports 112*c*, 112*b* and 112*a*.

In another aspect, the present disclosure further provides, in one aspect, an embodiment of a method of controlling cement flow from an inner passage 336 of a tubular string 104 to the exterior thereof, the method comprising:

constructing a tubular valve assembly 108 for interconnecting the tubular string 104, the assembly 108 comprising:

a first tubular member 210 having cement ports 220 through a wall of the tubular member 210;

a second tubular member 214 installed inside the first tubular member 210, and displaceable within the first tubular member 210 from a port closed position in which no fluid communication is allowed between the inner passage 336 and exterior of the tubular valve assembly 108 to a port open position in which flow of cement slurry is allowed between the inner passage 336 and the exterior of the tubular valve assembly 108;

the second tubular member 214 comprising a first interlocking piston 4 and a second interlocking piston 7, the first piston 4 comprising a first displacement limiting device 350 and the second piston 7 comprising a second displacement limiting device 325;

the first tubular member 210 comprising first apertures 221 allowing for fluid communication between the exterior of the first tubular member 210 and the first piston 4 and second fluid apertures 223 allowing for fluid communication between the exterior of the first tubular member 210 and the second piston 7;

displacing the second tubular member 214 relative to the first tubular member 210 in an downward direction and opening the ports 220;

supplying a flow of cement slurry through the inner passage 336 of the tubular valve assembly 108 wherein the cement slurry flows between the inner passage 336 of the valve assembly 108 and the exterior of the tubular valve assembly 108 through the ports 220;

reducing the cement slurry flow; and displacing the second tubular member 214 relative to the first tubular member 210 in an upward direction by actuating both the first displacement limiting device 350 and second displacement limiting device 325 in an upward direction and closing the ports 220; and then eliminating cement debris by actuating a valve at the distal end of the tubular string 104.

The act of eliminating the cement debris may involve the use of a low pressure port 1420 included in the tubular string downward (i.e. downstream) from a high pressure stimulation port 1440.

Alternatively, the act of eliminating the cement debris may involve the use of a low pressure port 1420 included in the tubular string downward from a high pressure stimulation port 1440, and upward (i.e. upstream) from a wellbore isolation valve 114.

The above disclosure generally describes various aspects of apparatuses and processes of the present disclosure. It will be appreciated by a person of skill in the art having carefully considered the above description of representative example embodiments of the present disclosure, that a wider variety of modifications, amendments, adjustments, substitution, deletions and other changes may be made to these specific embodiments, without departing from the scope of the present disclosure. Accordingly, the foregoing detailed description is to be understood as given by way of example and illustration only, the spirit and scope of the present disclosure being limited solely by the appended claims.

I claim as my invention:

1. A tubular valve assembly for cementing wellbores comprising:

a first tubular member having a port through a wall of the tubular member;

a second tubular member installed inside the first tubular member, and displaceable within and relative to the first tubular member from a port closed position in which no fluid communication is allowed between an inner passage of the second tubular member and an exterior of the tubular valve assembly to a port open position which allows for fluid communication between the inner passage and the exterior of the tubular valve assembly;

the second tubular member including a first piston having a first displacement limiting device, and a second piston having a second displacement limiting device; the first and second piston being mechanically connected to each other by linkage; the first and second pistons being arranged within the second tubular member;

the first tubular member further having a first fluid aperture and a second fluid aperture; the first fluid aperture allowing for fluid communication between the outer surface of the first tubular member and the first piston via the first fluid aperture; the second fluid aperture allowing for fluid communication between the outer surface of the first tubular member and the second piston via the second fluid aperture;

the second tubular member actuatable in a first axial direction by sufficient fluid pressure to displace the second tubular member inside the first tubular member from the port closed position to the port open position, until such movement is blocked by the first and second displacement limiting devices.

2. The tubular valve assembly according in claim 1 wherein the first displacement limiting device comprises a spring assembly having a coiled spring about the first piston and a spring resistant surface fixed in position to the inside surface of the first tubular member.

3. The tubular valve assembly according to claim 1, wherein the first displacement limiting device comprises a spring assembly having a plurality of springs circumferentially placed about the first piston and a spring resistant surface fixed to the first piston.

4. The tubular valve assembly according to claim 1, wherein:

the second tubular member being further actuable in an opposite axial direction by a combination of hydraulic pressure and mechanical actuation, the hydraulic pressure being exerted on the outer surface of the tubular valve assembly via the first and second fluid apertures, and the mechanical actuation being provided by the first displacement limiting device to retract the second tubular member inside the first second tubular member from the port open position to the port closed position.

5. The tubular valve assembly of claim 1 wherein the first and second pistons are longitudinally interlocking pistons.

* * * * *